United States Patent [19]

Dunand

[11] Patent Number: 4,844,503

[45] Date of Patent: Jul. 4, 1989

[54] SKI BINDING HAVING A CENTRAL LONGITUDINAL RIB AND LONGITUDINAL TONGUES

[75] Inventor: Josiane Dunand, Cran Gevrier, France

[73] Assignee: Salomon S.A., Annecy Cedex, France

[21] Appl. No.: 51,383

[22] Filed: May 19, 1987

[30] Foreign Application Priority Data

May 21, 1986 [FR] France ..... 86 07227

[51] Int. Cl.[4] ..... A63C 9/10

[52] U.S. Cl. ..... 280/615; 280/607; 280/633

[58] Field of Search ..... 280/607, 609, 614, 615, 280/633, 636, 618

[56] References Cited

U.S. PATENT DOCUMENTS

| | | | |
|---|---|---|---|
| 4,083,578 | 4/1978 | Moog et al. | 280/618 |
| 4,167,275 | 9/1979 | Weiss et al. | 280/605 |
| 4,194,758 | 3/1980 | Svoboda et al. | 280/605 |
| 4,382,611 | 5/1983 | Salomon | 280/615 |
| 4,484,762 | 11/1984 | Salomon | 280/615 |
| 4,496,169 | 1/1985 | Salomon et al. | 280/618 |
| 4,533,154 | 8/1985 | Bernard et al. | 280/615 |

FOREIGN PATENT DOCUMENTS

| | | | |
|---|---|---|---|
| 72766 | 2/1983 | European Pat. Off. . | |
| 0167462 | 1/1986 | European Pat. Off. | 280/615 |
| 3518400 | 12/1985 | Fed. Rep. of Germany | 280/615 |
| 2954446 | 5/1986 | Fed. Rep. of Germany . | |
| 2447731 | 8/1980 | France | 280/615 |
| 2497674 | 7/1982 | France | 280/615 |
| 2537011 | 6/1984 | France | 280/615 |

*Primary Examiner*—David M. Mitchell

*Attorney, Agent, or Firm*—Sandler & Greenblum

[57] ABSTRACT

An apparatus for attaching a front end of a ski boot to a ski, particularly for a cross-county ski, comprising a support pivotably mounted about an axis transverse to the longitudinal axis of the ski and retaining the front end of the boot on the ski. The apparatus further elastically biasing the support toward the rear of the ski. The biasing device being fixedly attached to the support which pivots about a fixed axis and is longitudinally displaceable with respect to the ski. The biasing device comprising at least one longitudinal tongue. The apparatus comprising a longitudinal rib adapted to be positioned on the ski surface and having at least one tongue attached to the support and being guided by the longitudinal rib.

64 Claims, 11 Drawing Sheets

FIG_4
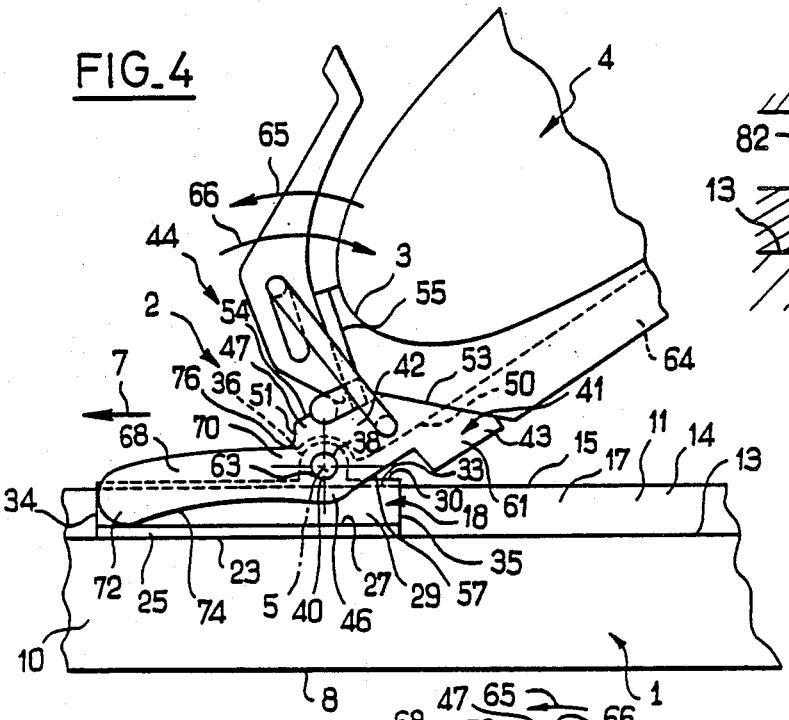
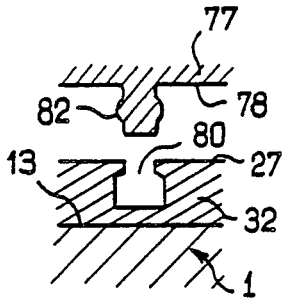
FIG_8
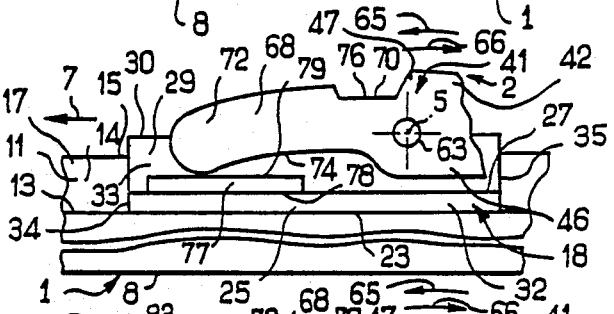
FIG_5
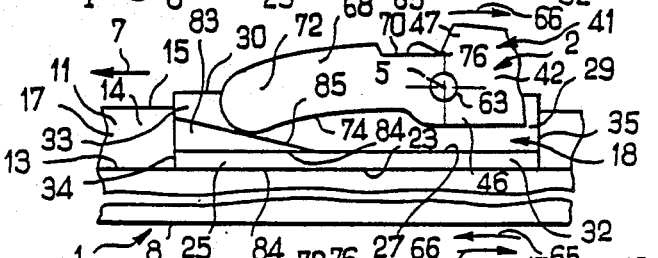
FIG_6
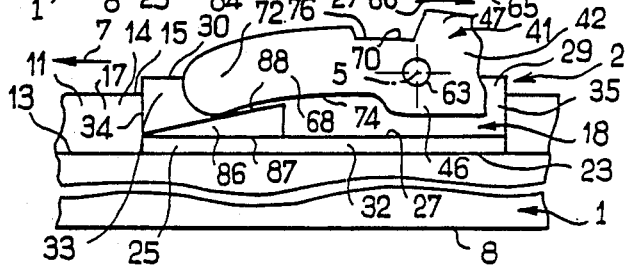
FIG_7

FIG. 9
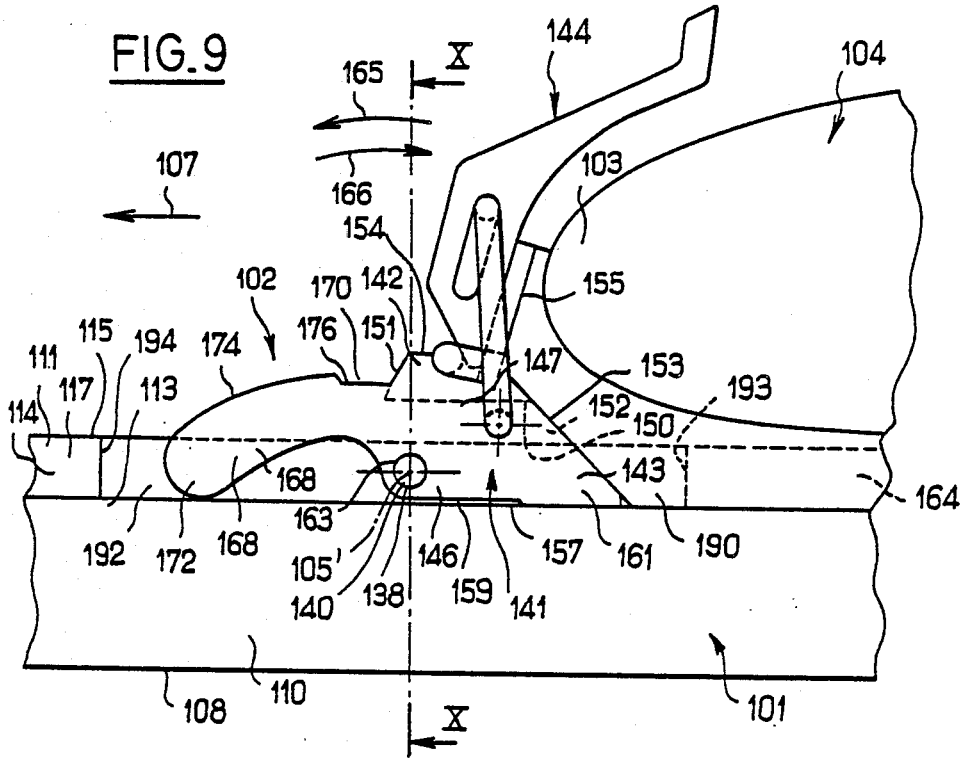
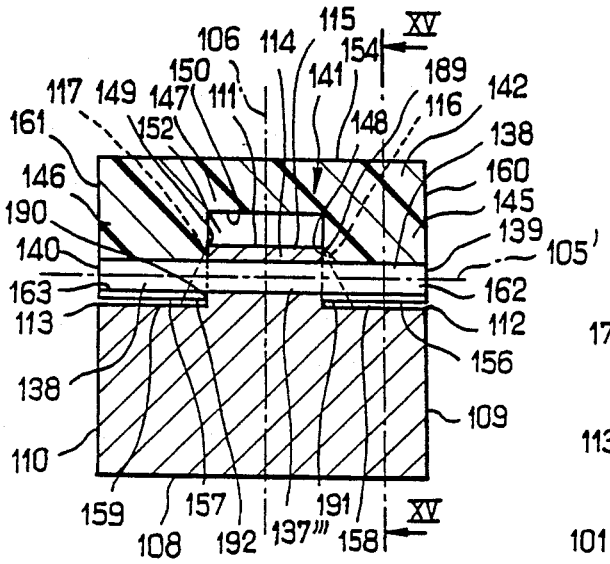
FIG. 10
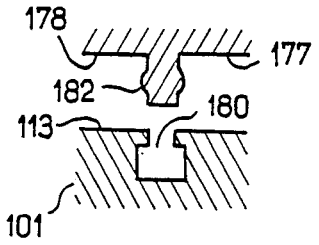
FIG. 15

SKI BINDING HAVING A CENTRAL LONGITUDINAL RIB AND LONGITUDINAL TONGUES

BACKGROUND OF THE INVENTION

1. Field of the Invention

The invention relates to an apparatus for attaching the front end of a boot to a longitudinal ski, particularly for use in cross-country skiing.

More particularly, it relates to an apparatus comprising a support adapted to be pivotably mounted around a transverse axis on a ski and to carry towards the rear, a retention apparatus of the front end of the boot. The attachment apparatus further comprises elastic bias means for rotation of the support around the longitudinal axis of the ski, in a predetermined direction for biasing movement of the support towards the rear and towards the bottom of the ski.

2. Description of Background and Relevant Materials

Apparatus of this type are known, and are described for example, in French Patent Application No. 2,447,731 and its corresponding U.S. Pat. Application Ser. Nos. 4,382,611 and 4,484,762 belonging to Applicant's assignee, particularly with reference to FIGS. 29 and 30 of the French document, the disclosures of which are hereby incorporated by reference thereto, and in French Patent Application No. 2,537,011 belonging to Applicant's Assignee, particularly with reference to FIGS. 8 and 9 of the French document, the disclosure of which is hereby incorporated by reference thereto.

These known apparatus are provided with a mounting on the skis having a smooth upper longitudinal surface, on which a base plate is screwed down flat to define the transverse axis of rotation of the support with respect to the ski.

Cross-country skis are presently being developed whose upper surface has a longitudinal rib bordered by two longitudinal strips.

On such skis having ribs, the known apparatus described for example by the two documents noted above, can be mounted by means of a covering zone or compensation element covering the rib and the longitudinal strips of the upper surface situated respectively on both sides thereof. This compensation element having, towards the top, a smooth surface adapted to allow for the mounting of the base plate of the known apparatus. Alternatively, one can provide for shaping this base plate, towards the bottom, such that it mates with the rib and the longitudinal strips of the upper surface bordering it. In either embodiment, it is appropriate to modify the geometry of the retention apparatus of the front end of the boot on the support to permit variation of the seating of the boot on the ski.

Such adaptations of an apparatus of the known type are not completely satisfactory because they permit a lifting of the assembly of the apparatus with respect to the ski, particularly with respect to the longitudinal edges thereof. This increases the friction against the snow as well as the risks of accumulation of snow in front of the apparatus. Furthermore, this apparatus becomes more vulnerable to shocks, particularly in its front portions where the elastic bias means are generally located, resulting in increased risk of deterioration.

SUMMARY OF THE INVENTION

It is a principle object of the invention to provide an apparatus for attaching the front end of a ski boot to a ski, particularly a cross-country ski, having a longitudinal axis, an upper longitudinal surface, a front portion and a rear portion. The apparatus comprises a support pivotably mounted about an axis transverse to the longitudinal axis of the ski, and having means for retaining the front end of the boot on the ski. The retaining means is positioned adjacent a rear portion of the attaching apparatus. The apparatus further comprises means for elastically biasing the support toward the rear portion of the ski. The biasing means comprises two longitudinal tongues attached to the support and adapted to be flexibly supported on the longitudinal surface of the ski when the apparatus is attached thereto. Each tongue comprises elastically flexible biasing means.

It is a further object of the invention to provide a front end of each tongue adapted to be displaced along the longitudinal axis.

It is a further object of the invention to provide each tongue freely longitudinally displaceable.

It is further an object of the invention to provide the longitudinal surface of the ski comprising a longitudinal rib. Each tongue comprises two tongues positioned on opposing sides of the rib. The apparatus comprises opposed strips positioned on opposite sides of the rib and positioned below the rib. Each tongue is positioned on each opposite side of the rib.

It is a further object of the invention to provide the apparatus wherein the upper longitudinal surface of the ski has a flat surface and further comprises a longitudinal rib wherein the intermediate mounting element straddles the rib and is complementary to the rib, its sides and the flat surface. The bottom portion of each tongue is supported by each longitudinal strip such that displacement of each tongue comprises displacement at least over a portion of the pivoting of the support.

It is an object of the invention to provide the tongues and support integrally formed from a single piece of flexible material.

It is another object of the invention to provide a raised surface positioned on the intermediate mounting element for altering the elastic bias of the biasing means. This raised surface may be removably mounted on the intermediate mounting element, for example, by a tongue and groove connection. This connection may comprise a projection which is force-fit into a hollow cutout means positioned in the intermediate mounting element. The raised surface may have a substantially flat top. In alternate embodiments, the raised surface may comprise a cam inclined either forwardly or rearwardly.

It is a further object of the invention to construct the intermediate element comprising means for abutment with the support at a rear portion of the support.

It is a further object of the invention to provide the longitudinal tongue including a zone of reduced thickness defining an elastic flexion zone. This zone may comprise a cutout portion positioned on the top or bottom portion. It is a further object of the invention to construct the tongues as being prestressed.

It is a still further object of the present invention to provide the apparatus with a pin positioned parallel to the transverse axis wherein the biasing means is adapted to be supported by the pin. The apparatus may comprise adjustment means for adjusting the position relative to the front ends of the tongue. The adjustment means comprises a plurality of bores wherein the pin is removeable and replaceable in each bore. The intermediate mounting element is mounted on the longitudinal surface of the ski and comprises a slot positioned on the longitudinal surface on each side of the rib. The biasing means comprises a pin positioned parallel to the transverse axis and wherein the pin is supported in each slot between the front portion of the tongue and the transverse axis. The apparatus further comprises a longitudinal rib mounted on the upper surface of the ski wherein a pin further comprises a projection on each side of the longitudinal rib.

In an alternate embodiment, the apparatus may comprise an intermediate mounting element mounted on the upper longitudinal surface of the ski wherein each tongue comprises a longitudinal slot and the intermediate mounting element comprises a pin engaging the slot such that the pin is slideably positioned within that slot. The longitudinal surface of the ski comprises a protuberance on each side of the longitudinal rib.

In either of these embodiments, the slot may be inclined forwardly or rearwardly.

It is a further object of the invention to provide the apparatus comprising means for limiting displacement of the biasing means. The limiting means further comprises means for guiding displacement. The limiting further comprises a transverse element comprising means for abutment with the biasing means. In one embodiment, the biasing means comprises a front portion comprising a cutout adapted to engage the limiting means. In an alternative embodiment, the limiting means comprises a longitudinal element. In this embodiment, the biasing means comprises a front portion having a slot, the longitudinal element engaging the slot thereby limiting longitudinal displacement. The longitudinal element comprises an adjustable screw.

It is a further object of the present invention to provide the tongue comprising a top and a bottom portion wherein at least one of the top and bottom portions is in the shape of a wedge. A front end of the longitudinal tongue further comprises a lower surface in the shape of a wedge. Each tongue comprises a front portion comprising means for supporting each tongue on the longitudinal upper surface and wherein the supporting means comprises a convex portion positioned on the bottom surface. A front end of the longitudinal tongue comprises a planar zone.

It is a further object of the present invention to provide an apparatus for attaching a front end of a ski boot to a ski wherein the transverse axis is positioned at the level of the longitudinal surface. In alternate embodiments, the transverse axis is vertically displaced from the longitudinal surface, positioned above or below this longitudinal surface. In the embodiment in which the transverse axis is positioned above the longitudinal surface of the ski, the intermediate mounting element is mounted on the longitudinal surface and the transverse axis on which the support is pivotably mounted on the intermediate element. In this embodiment, the axis about which the support is pivotably mounted extends through the intermediate element and the longitudinal rib. In an alternate embodiment, in which transverse axis is positioned below the longitudinal surface, the transverse axis is positioned in a recess of the ski. The rear portion of the attaching apparatus rests on the upper support of the ski. In the embodiment in which the support is mounted at the level of the longitudinal surface, the support is mounted directly on the ski.

It is a primary object of the invention to provide an apparatus for attaching a front end of a ski boot to a ski, particularly a cross-country ski, the ski having a longitudinal axis, an upper longitudinal surface, a front portion and a rear portion. The apparatus comprises a support pivotably mounted about a fixed axis transverse to a longitudinal axis of the ski and comprises means for retaining the front end of the boot on the ski. The retaining means is positioned adjacent a rear portion of the attaching apparatus. This apparatus further comprises means for elastically biasing the support towards the rear portion of the ski. The biasing means comprises means fixably attached to the support and adapted to be flexibly supported on the ski. The biasing means is adapted to be longitudinally displaceable when the apparatus is attached to the ski.

It is a further primary object of the invention to provide an apparatus for attaching a front end of a ski boot to a ski, particularly for a cross-country ski, the ski having a longitudinal axis, an upper longitudinal surface, a front portion and a rear portion. The apparatus comprises a longitudinal rib adapted to be positioned on the longitudinal ski surface. The attaching apparatus has a front portion and a rear portion and further comprises a support pivotably mounted about an axis transverse to the longitudinal axis of the ski. The apparatus comprises retaining means for retaining the front end of the boot on the ski positioned toward the rear portion of the attaching apparatus. The attaching apparatus further comprises means for elastically biasing the support towards the rear portion of the ski. The biasing means further comprises at least one longitudinal tongue attached to the support and being guided by the longitudinal rib.

It is a further object of the invention to provide any embodiment of the apparatus in combination with a ski and being attached to the upper ski surface.

The intermediate mounting element comprises means for covering the upper longitudinal surface of a rib on the ski and to lower longitudinal surfaces of the ski and thereby comprises a plurality of covering zones.

At least one wedge can be positioned on at least one of the covering zones; and one of the covering zones is an intermediate zone which is positioned within two of said tongues. This element is attached via a transverse member to a rib on the ski which includes at least a portion of the upper longitudinal ski surface. The mounting element comprises at least one substantially planar surface for supporting the transverse member.

BRIEF DESCRIPTION OF THE DRAWINGS

Other characteristics and advantages of the present invention, will become clear from the description below, with reference to several non-limiting embodiments of the apparatus, and the text which follows, in which;

FIG. 4 illustrates a view of the apparatus of FIG. 1 in cross-section, while the apparatus is in a pivoting position of the support towards the front and top with respect to the ski;

FIGS. 5–7 illustrate partial views corresponding to the view of FIG. 2, alternative embodiments of effecting the flexibility characteristics of the tongues as a function of the angular position of the support with respect to the ski, by means of wedges;

FIG. 8 illustrates, in cross-sectional view through a longitudinal plane corresponding to the plane identified as VIII—VIII in FIG. 3, a removable mounting of the wedges thus provided;

FIGS. 9–15 illustrate, in views analogous respectively to those of FIGS. 2–8, a second embodiment of an apparatus according to the invention;

FIG. 10 corresponds to a cross-sectional view through a transvere plane identified as X—X in FIG. 9;

FIG. 15 corresponds to a cross-sectional view through a longitudinal plane identified as XV—XV in FIG. 10;

FIG. 17 illustrates a view in cross-section through a transverse plane identified as XVII—XVII in FIG. 16;

DESCRIPTION OF PREFERRED EMBODIMENTS

Figure 1:
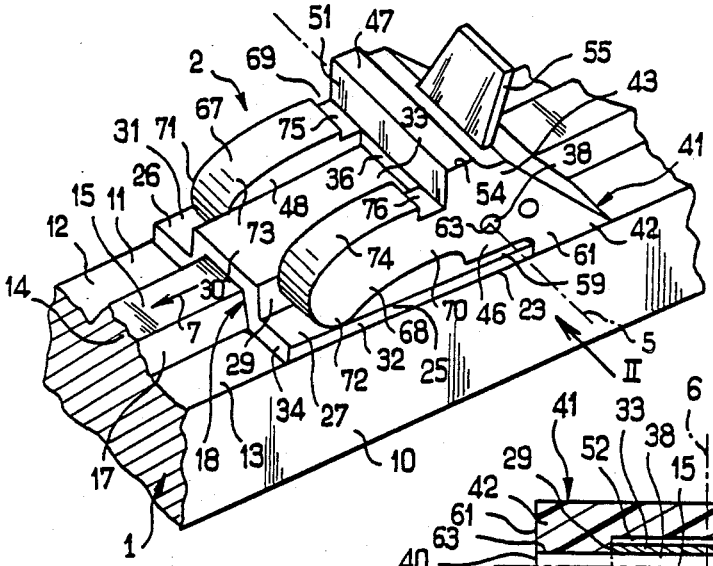
FIG. 1 illustrates a perspective view of a first embodiment of the invention, mounted on a ski, the apparatus according to the invention being illustrated in a maximum limit position of movement of the support towards the rear and bottom of the ski.

The aim of the present invention is to overcome the above disadvantages by providing an apparatus for attaching the front end of a boot to a ski, particularly a cross-country ski, specifically adapted for a ski whose upper surface has a longitudinal rib bordered by two longitudinal strips.

To this end, the apparatus according to the invention is defined in a manner to be herein described.

A support is adapted to be pivotably mounted around a transverse axis on the ski and carries, towards the rear, a retention apparatus of the front end of the boot. Elastic bias means biases the support towards the rear and the bottom of the ski for rotation around the transverse axis. The elastic bias means comprises two elastically flexible longitudinal tongues, each positioned on opposite sides of the rib and having a rear end affixed to the support and a front end adapted to be supported on the bottom of the ski. The tongues are capable of free longitudinal displacement with respect to the ski, at least over a portion of the path of rotation of the support.

This solution makes it possible to considerably reduce the obstruction of the elastic bias means, with respect to the ski, in the direction of the height by carefully exploiting the space exposed by the difference in level between the longitudinal rib and the two longitudinal strips which border it. These elastic bias means thus become less vulnerable to shock and their presence near the edges of the ski translates into a lifting of the lower edges which is less than the lifting which these edges have when the elastic bias means are situated at a level above that of the rib. This results in less uptake of snow. The transverse axis around which the support is journalled to the ski can be positioned above the longitudinal rib. By positioning the journal axis either at the level of the longitudinal rib or beneath it, the advantage of reducing the obstruction of the assembly is further increased.

For any of the alternative positions adopted for the axis, the support can be pivotably mounted around this axis directly on the ski, or one can provide an intermediate mounting element adapted to be fixed to the upper surface of the ski while straddling the rib, in which case the support is pivotably mounted around the axis on this intermediate element.

As will become clear below, different embodiments for supporting the tongues on the bottom of the ski, either prestressed or not, can be provided to cause the support to rotate in the direction of elastic bias towards the rear and bottom of the ski as a function of the effective angular position of the support with respect to the ski, around the transverse axis of their mutual journal. Similarly, one can provide relative abutment means of the front ends of the tongues in at least a longitudinal direction with respect to the ski to impose a limit to the free longitudinal displacement of the front ends of the tongues in a longitudinal direction corresponding to the direction of movement of the support towards the rear and bottom of the ski or in a reverse longitudinal direction or in the two longitudinal directions, which causes a different manner of flexion of the tongues and of elastic bias of the support when this limit is reached. In other words, by virtue of an appropriate choice of the embodiment of support of the tongues with respect to the ski, one can provide that as the support pivots upwardly and towards the front with respect to the ski, around their mutual transverse journal axis, the elastic bias means oppose an increasing force, or decreasing force, or constant force, or are further variable in a manner selected freely, to such a pivoting.

According to a preferred embodiment of the apparatus according to the invention, the tongues are formed of an elastically flexible material integral with the support. In the mid-section of each tongue, a zone of reduced thickness defines a preferred elastic flexion zone of the tongue. Thus, the front end of each tongue can be without any elastic flexibility and can be dimensioned so as to have a rigidity such that it does not deform when the tongue flexes. The rigidity of the tongue in the zone in which it receives the downward support forces makes it possible to more easily provide the elastic flexion characteristic of the tongue, to calculate it more easily, and furthermore increases the durability of the tongue.

Depending upon the particular embodiment, one can provide a direct support of the front end of each tongue on the ski, which makes it possible to provide a simple and economical structure of the apparatus. When there is provided an intermediate mounting element of the support on the ski, the front ends of the tongues are supported on the ski by means of this intermediate mounting element. This makes it possible to benefit from the advantages of the apparatus according to the invention on a ski whose upper surface has insufficient resistance to abrasion under the effect of a longitudinal displacement of the front ends of the tongues with respect to it, or which has a coefficient of friction which is too great to permit longitudinal translation of the tongues.

Referring to FIGS. 1–4, there is illustrated a central portion of a cross-country ski 1, which carries an apparatus according to the invention 2, adapted to assure the attachment of the front end 3 of boot 4 with the ski 1 and to permit relative pivoting around a transverse axis 5 of ski 1 and boot 4 with respect to a longitudinal median plane 6 of the ski 1.

For reasons of simplicity, plane 6 will be assumed to be vertical in the description which follows, axis 5 thus being positioned horizontally, and it will be assumed that ski 1 itself is horizontal and placed in a normal position of use. In particular, it will be considered that a longitudinal direction 7 constituting the normal direction of displacement of the ski is horizontal. Naturally, the references to orientation and level which follow from the description should only be taken as being indications of relative positioning, without implying limitation as to the conditions of use of the apparatus according to the invention. It is the same for the other embodiments of the apparatus according to the invention, likewise described in a normal position of use of the ski, which is assumed to be horizontal.

Ski 1 which is illustrated is of the "edged" type and comprises in its longitudinal median zone, a longitudinal bottom surface 8, perpendicular to plane 6, two edge surfaces 9 and 10 likewise longitudinal and both positioned parallel to one another and to plane 6, and an upper surface 11. Surfaces of sides 9 and 10 connect upper surface 11 to bottom surface 8. In a characteristic manner, the upper surface 11 of ski 1 has two longitudinal strips 12 and 13 which are positioned at the junction of upper surface 11 and sides 9,10 and are generally parallel to bottom surface 8. These two strips 12 and 13 of upper surface 11 border a longitudinal rib 14 of the ski 1. Rib 14 is positioned longitudinally with respect to the ski and has a crosssection of isosceles trapezoid configuration. This crosssection is defined by an upper longitudinal surface 15 offset upwardly with respect to strips 12 and 13 and by two planar side surfaces 16 and 17 connecting surface 15 to strips 12 and 13, respectively. Surfaces 16, 17 are positioned symmetrically to one another with respect to plane 6, and converging mutually upwardly. The shape of upper surface 11 of ski 1 is only one non-limiting example and one can construct rib 14 unsymmetrical with respect to plane 6 and/or that strips 12 and 13 be mutually unsymmetrical with respect to this plane, and/or that rib 14 has a different cross-section than that of an isosceles trapezoid, for example, a triangular cross-section, in which case its upper surface 15 will be reduced to a junction edge between its side surfaces 16 and 17. One of ordinary skill in the art will be able to modify without difficulty and without going beyond the scope of the present invention the apparatus according to the invention 2 which will be described at this time as a function of these possible differences of shape of the upper surface 11 of ski 1.

In its embodiment illustrated particularly in FIGS. 1–4, the apparatus 2 according to the invention comprises an intermediate mounting element 18, to be affixed to the upper surface 11 of the ski and having a shape adapted to surface 11 to better mate with it, by straddling rib 14 and covering the two longitudinal strips 12 and 13 in the longitudinal central zone of the ski. The attachment of the intermediate mounting element 18 with the upper surface 11 of the ski can be performed by any appropriate means, known to one of skill in the art, for example, by screwing or gluing in a localized manner or distributed over as large a surface as possible.

The intermediate mounting element 18 has an omega-shaped cross-section defined by five generally planar longitudinal surfaces: lower surfaces, 19, 20, 21, 22, 23 which are tightly complementary and mate with strip 12 of side 16, upper surface 15, side surface 17 and strip 13, respectively; two edge surfaces 24 and 25 which are generally planar, parallel and symmetrical to one another extend upwardly from the surface of edge 9 and the surface of edge 10, respectively, connected to surface 19 of element 18 and to surface 23 thereof; five upper planar surfaces, i.e., two surfaces 26 and 27 respectively adjacent to vertical edge surfaces 24 and 25, positioned perpendicularly to plane 6 and parallel to direction 7, two surfaces 28 and 29 symmetrical to one another with respect to plane 6 and parallel thereto in being turned in the direction of a distancing with respect thereto, and a surface 30 parallel and upwardly offset with respect to surfaces 26 and 27 connected by surfaces 28 and 29; the surfaces 26 and 27 define with surfaces 19 and 23, respectively, two zones 31 and 32 for covering longitudinal strips 12 and 13 of the upper surface 11 of ski 1 by intermediate element 18, while surfaces 28, 30, 29 define with surfaces 20, 21, 22 a zone 33 straddling rib 14 by means of element 18.

Towards the front and rear, with reference to direction 7, element 18 is defined by two planar transverse surfaces 34 and 35 perpendicular to direction 7 which connect the longitudinal surfaces of intermediate mounting element 18.

In a zone closer to the transverse rear surface 35 than to the front transverse surface 34, upper surface 30 of element 18 carries in an affixed manner, in upward projection, a localized protuberance 36 spaced with respect to plane 6 by coplanar localized extensions of surfaces 28 and 29; along axis 5, situated above the upper surface 15 of rib 14, the localized protuberance 36 is bored on both sides, i.e., from the surface 28 to the surface 29 perpendicular to axis 6, with a cylindrical bore 37 around axis 5 having a diameter that is not secant to surface 21 of intermediate element 18. To this end, this diameter is less than double the distance separating axis 5 from surface 21 perpendicular to the latter.

Figure 3:
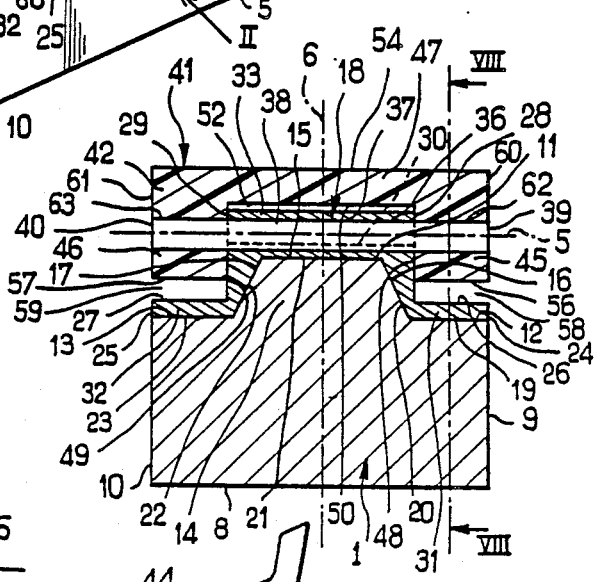
FIG. 3 illustrates a view of the apparatus in cross-section through the transverse plane identified as III—III in FIG. 2.
Figure 2:
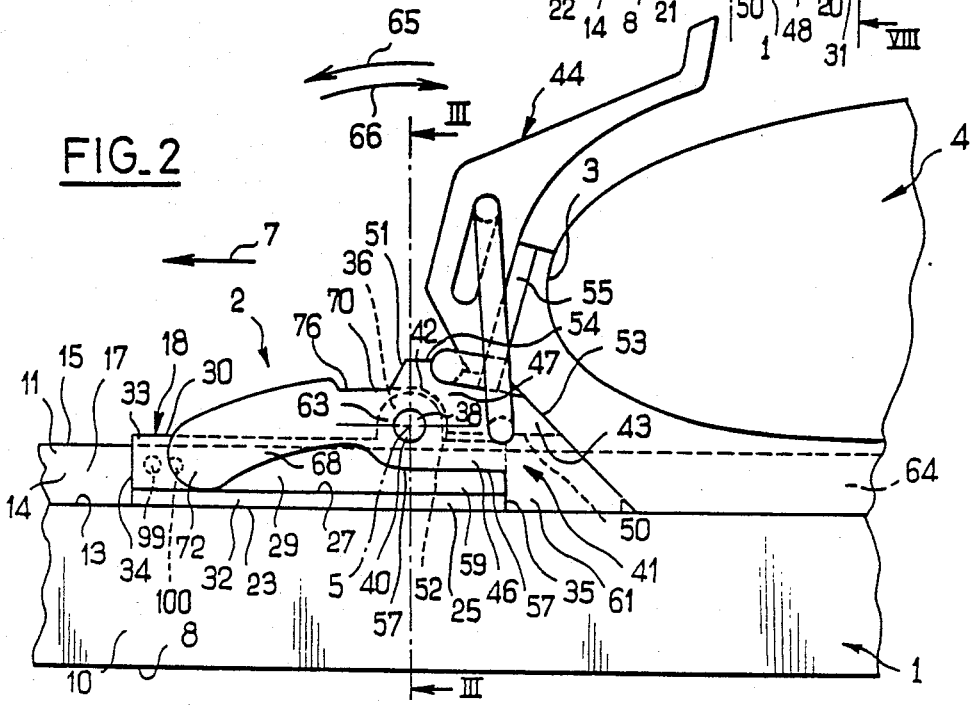
FIG. 2 illustrates a lateral cross-sectional view of the apparatus of FIG. 1 along arrow II of FIG. 1, illustrating a complete retention apparatus.
Figure 2A:
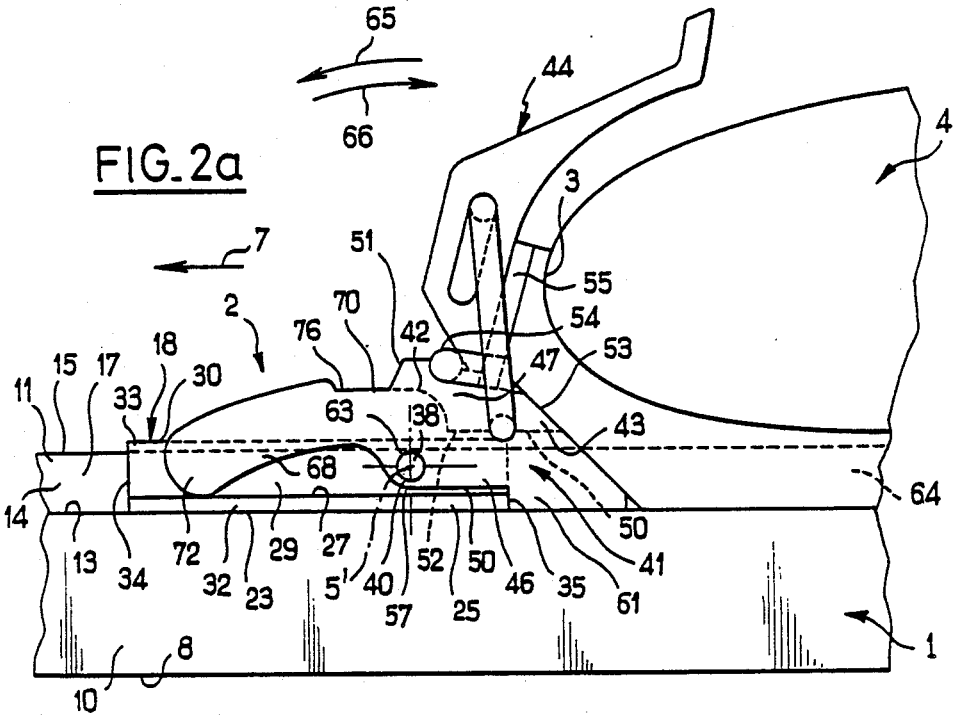
FIGS. 2*a* and 3*a* in views corresponding respectively to the views of FIGS. 2 and 3, an alternative embodiment to that of FIG. 1.
Figure 3A:
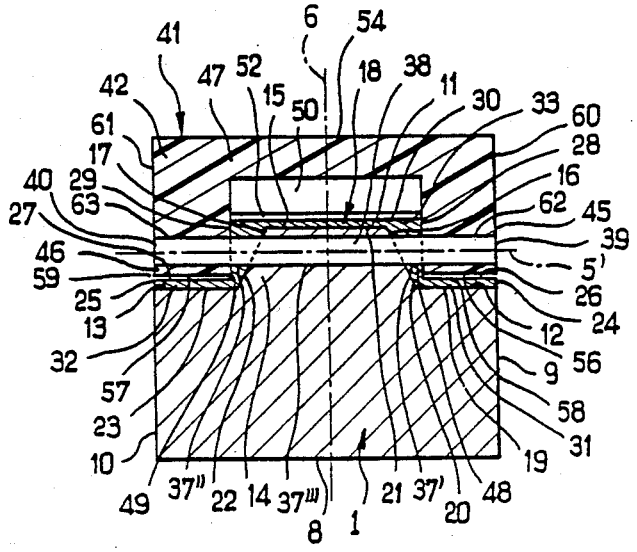

In an alternative embodiment illustrated in FIGS. 2*a* and 3*a* in which the same elements are shown as in FIGS. 2 and 3, utilizing the same reference numerals, differing in that the transverse journal axis of zone 3 of the front end of boot 4 on ski 1 intersects the ski 1 at the level of rib 14, such a position of this axis being shown at 5' in FIGS. 2*a* and 3*a*. In this case, surface 30 can be without protuberance 36 and bore 37 is replaced by two bores 37' and 37'' which are cylinders of revolution around axis 5', respectively, between surfaces 28 and 20 and between surfaces 22 and 29, with identical diameters and such that these bores are integrally situated between surface 21 and surfaces 26 and 27, respectively.

In particular, these diameters are less than the distance separating surface 21 from surfaces 26 and 27 and less than double of the smaller of the distances separating axis 5' from surface 21 and from surfaces 26 and 27. The axis 5' of bores 37' and 37'' extend coaxially, in rib 14, through a bore 37''' of identical diameter, that is, non-secant to the upper surface 15 of rib 14.

Bore 37 of FIG. 3 or the assembly formed by the coaxial bores 37', 37'', 37''' of FIG. 3*a* receives a coaxial pivot 38 of the general shape of a cylinder of revolution around axis 5 or 5' with a diameter substantially identical to the diameter of bore 37 or to the diameters of bores 37', 37'', 37'''. One can either provide an immobilization of pivot 38 against a rotation around axis 5 or 5' or against a translation parallel to this axis 5 or 5' by any appropriate means in bore 37 or in bores 37', 37'', 37'''. In an alternative embodiment discussed below, free sliding occurs between pivot 38 and bore 37 or bores 37', 37'', 37'''.

Along axis 5 or 5', pivot 38 has a length greater than the distance separating surfaces 28 and 29 of the intermediate mounting element so that, when it is placed symmetrical with respect to plane 6, this pivot 38 forms a projection with respect to two surfaces 28 and 29, respectively above the surface 26 of surface 27. For example, pivot 38 is defined by end surfaces 39 and 40, is perpendicular to axis 5 or 5', and surfaces 39 and 40 are coplanar and equidistant from surfaces 24 and 25, respectively, when pivot 38 is placed symmetrical to plane 6.

Pivot 38 serves as a guide, for rotation around axis 5 or 5' with respect to element 18 without any possibility of relative displacement, of substantially rigid zone 42, of a support 41 having further, at the rear of zone 42 and in at least approximately rigid attachment with zone 42, a zone 43 in which this support 41 carries a retention apparatus 44 for the front end 3 of boot 4. This apparatus can be of any type which is known in itself, adapted to be affixed with zone 43 of support 41 of zone 3 of the front end of boot 4 or, as desired, to free the boot 4 with respect to support 41. By way of non-limiting example, a retention apparatus 44 has been illustrated of the type described in French Patent Applications Nos. 2 447 731 and 2 537 011 which have been referenced above.

Preferably formed of a single element, zones 42 and 43 of support 41 have a shape adapted to straddle element 18, by surfaces 28, 29, 30 including the localized protuberance 36, if desired, from in front of axis 5 or 5' up to the rear transverse surface 35. More specifically zone 43 straddles rib 14 at surfaces 15, 16 and 17 at the rear of the rear transverse surface 35 of element 18.

Zones 42 and 43 of support 41 thus have, as will become clear from FIG. 3 with respect to zone 42, the shape of an inverted U when they are viewed in cross-section through a plane perpendicular to direction 7.

Considered in their entirety, zones 42 and 43 have two wings 45 and 46, one positioned on either side of element 18 facing surfaces 26 and 28 of element 18 and facing surfaces 27 and 29 thereof. These two wings 45 and 46 are both connected, above the upper surface 30 of element 18 as well as below the localized protuberance 36 of this surface 30, by a core plate 47. Towards each other, wings 45 and 46 have planar facing surfaces 28 and 29 of element 18, planar surfaces 48 and 49 which are parallel and symmetrical with respect to one another and to plane 6 and equidistant therefrom. This distance is substantially equal to the distance separating surfaces 28 and 29 of element 18, with which surfaces 48 and 49 are in contact, respectively, with a possibility of mutual sliding. Surfaces 48 and 49 thus defined extend upwardly until connecting to a lower surface 50 of core 47, which surface 50 is positioned facing localized protuberance 36, as well as facing surface 30 of element 18 at the rear of localized protuberance 36 and facing upper surface 15 and of rib 14 at the rear of transverse rear surface 35 of element 18, providing for a continuous clearance 52 of approximately constant thickness if one refers to the position of support 41 illustrated in FIG. 2.

Above the optional localized protuberance 36, surface 50 is interrupted towards the front to be connected to a transverse front surface 51 of core 47, which is planar and oriented perpendicularly to plane 6 while ascending towards the rear if one refers to FIG. 2 or 2*a*.

Towards the rear, surface 50 is connected, as are surfaces 48 and 49, to a planar surface 53, perpendicular to plane 6 and ascending towards the front in the position illustrated in FIG. 2 or 2*a*, which planar surface constitutes for front end zone 3 of boot 4 an abutment surface towards the front and towards the bottom as is clear from the French Patent Application Nos. 2 447 731 and 2 537 011 and U.S. Pat. Nos. 4,382,611 and 4,484,762 to which reference has been made. Towards the top and front, abutment surface 53 is connected to surface 51 by an upper surface 54 of core 47. Surface 54 carries in an affixed fashion, in upward projection and towards the rear a support element 55 receiving the front and top for zone 3 of the front end of boot 4, as was described in French Application Nos. 2 447 731 and 2 537 011 and U.S. Pat. Nos. 4,382,611 and 4,484,762. Support element 41 and abutment surface 53 form an integral portion of retention apparatus 44 and will not be further described herein.

Towards the bottom, the two surfaces 48 and 49 connect two respective lower surfaces 56 and 57 of wings 45 and 46. Surfaces 56 and 57 are perpendicular to plane 6 and symmetrical with respect to one another. In zone 42, surfaces 56 and 57 are coplanar and positioned parallel to surfaces 26 and 27 of intermediate element 18, providing for a clearance 58, 59 if one refers to the position illustrated in FIG. 2 or FIG. 2*a*. At the transverse level of rear surface 35 of element 18, surfaces 56 and 57 flex downwardly, so that surfaces 56,57 form planar zones resting flat against strips 12 and 13 respectively, of upper surface 11 of the ski 1 in the position illustrated in FIG. 2 or 2*a*. Towards the rear, these planar zones of surfaces 56 and 57 are connected to an abutment surface 53 along the length of a cut edge.

In the direction of a spacing with respect to plane 6, wings 45 and 46 of support 41 are defined by planar surfaces 60 and 61, respectively, which are mutually parallel and symmetrical to one another with respect to plane 6 and preferably coplanar with surfaces 9 and 24 and surfaces 10 and 25, respectively. Surface 60 thus connects surfaces 56, 53, 54, 51, while surface 61 connects surfaces 57, 53, 54, and 51.

The height of surfaces 56 and 57, particularly when the support 41 occupies its position illustrated in FIG. 2 or 2*a*, is intermediate between the lower level of bore 37 or bores 37', 37'', 37''', i.e., the lower level of pivot 38 in its zones projecting respectively on both sides of element 18, and the level of surfaces 26 and 27 of zones 31 and 32 covering strips 12 and 13 of upper surface 11 of the ski. Thus, axis 5 or 5' cuts wings 45 and 46 which are both bored along this axis, between surfaces 48 and 60 and between the surfaces 49 and 61, respectively, with respective bores 62 and 63 for receiving pivot 38.

The two bores 62 and 63 are cylinders of revolution around axis 5 or 5' with a diameter substantially identical to that of pivot 38 so as to assure by means of pivot 38 a guidance of support 41 in rotation around axis 5 or 5' with respect to element 18 without other possibility of relative movement. If pivot 38 is free to rotate in bore 37 or in bores 37', 37'', 37''', it is affixed by any mean with support 41 in bores 62 and 63. If on the other hand pivot 38 is immobilized within bore 37 or bores 37', 37'', 37''', it is free to rotate around axis 5 or 5' in bores 62 and 63.

Thus, support 41 can occupy the position illustrated in FIGS. 2 or 2*a* as well as FIGS. 1 and 3 or 3*a*, in which surfaces 56 and 57 rest against strips 12 and 13 at the rear of element 18. Boot 4 can optionally be affixed by retention apparatus 44 with zone 43 of support 41 resting on the upper surface 11 by mating this surface with a longitudinal groove of sole 64. Additional positions such as the position illustrated in FIG. 4 can be assumed and in which, by an ascending of the heel of the boot and a pivoting of the support 41 around axis 5 or 5' with respect to element 18 in a direction 65 extending longitudinally towards the front above axis 5 or 5', the zones of surfaces 56 and 57 initially resting on strips 12 and 13 of surface 11 of the ski are offset upwardly with respect to strips 12 and 13.

The position of the support 41 illustrated in FIGS. 1, 2 or 2*a*, 3 or 3*a* is the position support 41 assumes when it is not biased in the direction 65 by boot 4. Elastic return means of support 41 in a direction 66 opposite to direction 65, tend to elastically press support 41 by means of surfaces 56 and 57 against strips 12 and 13 at the rear of element 18.

According to the present invention these elastic bias means of support 41 comprise two longitudinal tongues 67 and 8 which are elastically flexible, and positioned respectively on both sides of rib 14, more specifically, on both sides of zone 33 of element 18. Each tongue has a respective rear end 69, 70 affixed to support 41 in front of zone 42 and axis 5 or 5' for journalling on element 18, front end 71, 72 which is supported on its bottom on surface 26, 27 respectively capable of free longitudinal displacement relative to element 18 and ski 1 by sliding on surface 26, 27. The Figure shows each tongue prestressed; however, it is within the scope of the invention to provide tongues which are not prestressed.

According to one embodiment not shown, tongues 67 and 68 can be in the form of elastically flexible elements, applied to support 41 which is rigid, forming zones 42 and 43. However, as it is shown, one can preferably make it possible to form tongues 67 and 68 out of a single element with support 41, grouping zones 42 and 43 by selecting as a material for this single element an elastically flexible or rigid material depending upon whether it is in the form of a plate or comparatively thin bar, or in the form of a comparatively compact block. For example, one can select amongst known materials under the marks "ARNYTEL" or "HYTREL", which are polyamides, other materials possessing such a property being known to one of ordinary skill in the art and which can be selected without going beyond the scope of the present invention.

Thus, in the example illustrated, tongues 67 and 68 are formed in a single element with support 41 comprising zones 42 and 43. Coplanar surfaces 48, 49 face each other and plane 6 while coplanar surfaces 60, 61 face away from each other and are directed away from plane 6.

The two tongues 67 and 68 are symmetrical to one another with respect to plane 6 and are furthermore each defined by an edge surface, 73, 74. Edge surfaces 73, 74 are defined by rectilinear generating lines perpendicular to plane 6 resulting in a shape which, at the rear ends 69 and 70 through which tongues 67 and 68 are connected to zone 42 of support 41 immediately in front of axis 5 or 5'. FIGS. 2 and 2*a* illustrate the tongues flexed upwardly from surface 56 of wing 45 and from surface 57 of wing 46 while resting at a level lower than that of axis 5 or 5', then flexed downwardly and towards the front, with a concave shape, up to front end 71, 72 where the edge 73, 74 has a convex semi-cylindrical shape of revolution around an axis perpendicular to plane 6 by flexing first upwardly and then frontwardly then upwardly and towards the rear. Towards the top, from this semi-cylindrical zone, each of the edges 73 and 74 has a convex shape, with zones being approximately parallel to each other to the concave zone which it has towards the bottom as was previously stated, until adjacent the rear respective end 69 or 70, where the edge 73 or 74 is situated at a level above that of axis 5 or 5' and connects to the lower portion of surface 51 of zone 42 of support 41 by means of a respective cutout 75, 76 oriented perpendicular to plane 6 and extending respectively from surface 67 to surface 48 and from surface 49 to surface 68 to define at the level of the rear end 69, 70 of each tongue 67, 68 a localized thinning in the direction of height, defining a preferred elastic flexion zone of the tongue 67, 68 in the direction of height, to its connection with support 41 which is itself rigid In the position of support 41 illustrated in FIG. 2 or 2*a*, tongues 67 and 68 are prestressed so as to firmly apply support 41, by means of the respective zones of surfaces 56 and 57 situated at the rear of element 18, against strips 12 and 13 of upper surface 11 of the ski 1. The cutouts 75 and 76, located at the connection of the rear ends 69 and 70 of tongues 67 and 68 with support 41, have dimensions such that the average level of tongues 67 and 68 at their rear ends 69 and 70 is greater than the level of the axis 5 or 5'. The cutouts further cause support 41 to pivot in the direction 65 around axis 5 or 5' with respect to element 18, as is shown in FIG. 4. The two tongues 67 and 68 flex identically by sliding towards the front, by means of their respective front ends 71 and 72, against upper respective surfaces 26 and 27 of zones 31 and 32 of covering of strips 12 and 13. When support 41 pivots to its biased position of direction 66, front ends 71 and 72 of tongues 67 and 68 slide towards the rear on surfaces 26 and 27.

Alternatively, tongues 67 and 68 can be connected to support 41 at an average level lower than the level of axis 5 or 5', such that the pivoting of support 41 in the direction 65 results in a sliding of front ends 71 and 72 of tongues 67 and 68 towards the rear, and that pivoting in the return in the direction of 66 translates into a sliding of front ends 71 and 72 of tongues 67 and 68 towards the front. The more the flexion of tongues 67 and 68 increases with respect to their initial flexion corresponding to the position of support 41 illustrated in FIG. 2 or 2*a*, the more tongues 67 and 68 oppose resistance as a result of the pivoting of support 41 in direction 65, and tend to bias support 41 elastically to its return position illustrated in FIG. 2 or 2*a*.

It is possible to affect the elastic return force imposed on support 41 by tongues 67 and 68 by forming surfaces 26 and 27 of zones 31 and 32 of element 18, at the support of front ends 71 and 72 of tongues 67 and 68.

To this end, rather than providing an element 18 of a different shape to obtain a different elastic return effect, removable and replaceable wedges are adapted to be mounted on zones 31 and 32 of element 18.

Thus, in FIGS. 5–7 in which the same reference numerals are used as in the elements appearing in FIGS. 2 or 2*a*, a removable plate is mounted on planar surface 27. The plate has a lower planar surface 78 mounted on surface 27 of zone 32, an upper planar surface 79, parallel to surface 78, and slidably supporting front end 72 of tongue 68. An identical plate is, similarly, removably mounted on upper surface 26 of zone 31 to serve as a slidable support to the front end 73 of tongue 67. The support surfaces such as surface 79 of these two plates 77 are of constant level with respect to surfaces 26 and 27 of element 18, and the support of front ends 71 and 72 of tongues 67 and 68 on these plates instead of a direct support on surfaces 26 and 27 corresponds to an increased rigidity of tongues 66 and 67 opposing a pivoting of support 51 in the direction 65 with respect to element 18.

FIG. 8 shows one type of connection for plate 83. By way of removable mounting of plate 77 on zone 32 of element 18, FIG. 8 illustrates the use of a hollowed cutout 80 in surface 27 of zone 32, perpendicular to surface 27, with a localized narrowing in the immediate vicinity of surface 27, to receive a bulbous projection 82 force-fit therein and provided to project under surface 78 of plate 77, perpendicular to surface 78. Other means can be utilized for this purpose, and one can, for example, provide that instead of a blind bore, cutout 80 extends completely through zone 32 of element 18 and extends into ski 1 through a blind bore in which bulbous projection 82 is immobilized by traversing zone 32 of element 18. Naturally, the plate associated in a removable manner with zone 31 of element 18 can be affixed in the same manner.

FIG. 6 illustrates the removable mounting, on surface 27 of zone 32 of element 18 illustrated in FIG. 8 having a lower planar surface 84 flattened against surface 27 of zone 32, and an upper surface 85 which is planar and defined by generating lines perpendicular to plane 6, and rising towards the front with respect to lower surface 84 or surface 27 for downward support, under constraint of the front end 72 of tongue 68, in the form of a cam. An identical plate (not shown) is mounted on surface 26 of zone 31 of element 18 for supporting front end 73 of tongue 67. By virtue of such a mounting, one obtains a progressive increase in the elastic resistance opposed by tongues 67 and 68 to pivoting of element 61 in direction 65, i.e., a return that increases, in the direction 66, the more that the angular offset of support 41 with respect to its position illustrated in FIG. 2 is substantial, in the case where the front ends 71 and 72 of tongues 67 and 68 are displaced frontwardly when support 41 pivots in direction 65.

In FIG. 7 the mounting has been illustrated on surface 27 of zone 32 of element 18, of a cam plate 87 having a lower planar surface 86 glued to surface 27 and an upper surface likewise planar 88, defined by generating lines perpendicular to plane 6 and converging towards the front with respect to surfaces 86 and 27. An identical cam plate is located on surface 26 of zone 31 of element 18. The connection is, for example, formed by means of the type illustrated in FIG. 8. Where the pivoting of support 41 in direction 65 is accompanied by a displacement of the front ends 71 and 72 of tongues 67 and 68 towards the front, such a pivoting is accompanied likewise by a descending movement of these front ends 71 and 72 and, if the slope of surface 88 with respect to surface 87 is selected in an appropriate manner, easily determinable by one of ordinary skill in the art, this progressive descent can translate into a progressive reduction of elastic resistance opposed by tongues 67 and 68 to the pivoting of support 41 in the direction 65, i.e., by a progressive reduction of the elastic return of this support 41 in direction 66.

Instead of being planar, the support surfaces 85 ascending towards the front and 88 descending towards the front can have a curvilinear shape, defined by generating lines perpendicular to plane 6. Furthermore, where support 41 pivots in a direction 65, as illustrated in FIG. 2 or 2*a*, resulting in movement of front ends 71 and 72 of tongues 67 and 68 towards the rear, the desired effects described with reference to FIGS. 6 and 7 will be obtained by providing either a cam plate having a support surface rising towards the rear or a cam plate having a support surface descending towards the rear.

It will be noted that the intermediate mounting element 18 is not necessary when the desired position of the journal axis of the front end 3 of boot 4 cuts the ski at the level of the rib of the upper surface thereof, as is illustrated at 5′, or below this rib.

Figure 16:
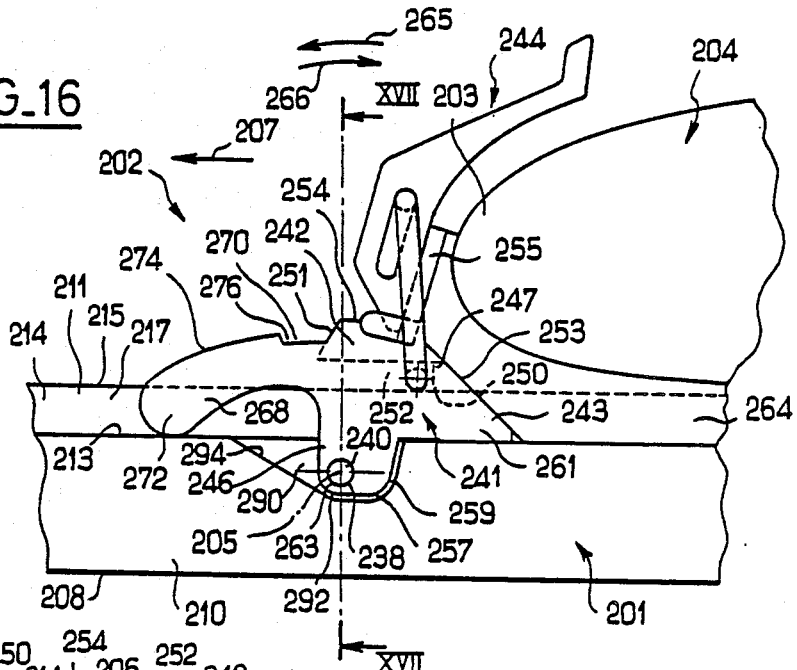
FIGS. 16–18 illustrate in views corresponding respectively to the views of FIGS. 2–4, a third embodiment of an apparatus according to the invention.
Figure 17:
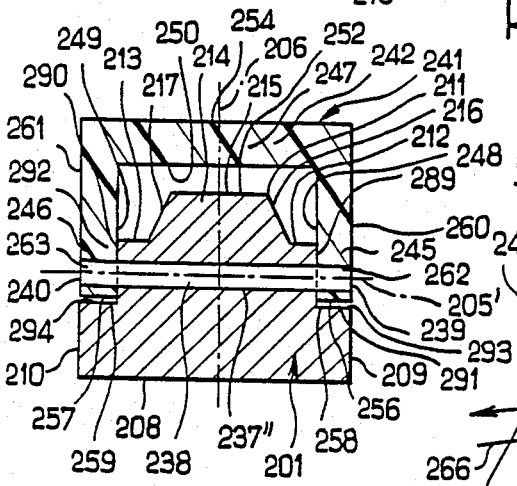
Figure 18:
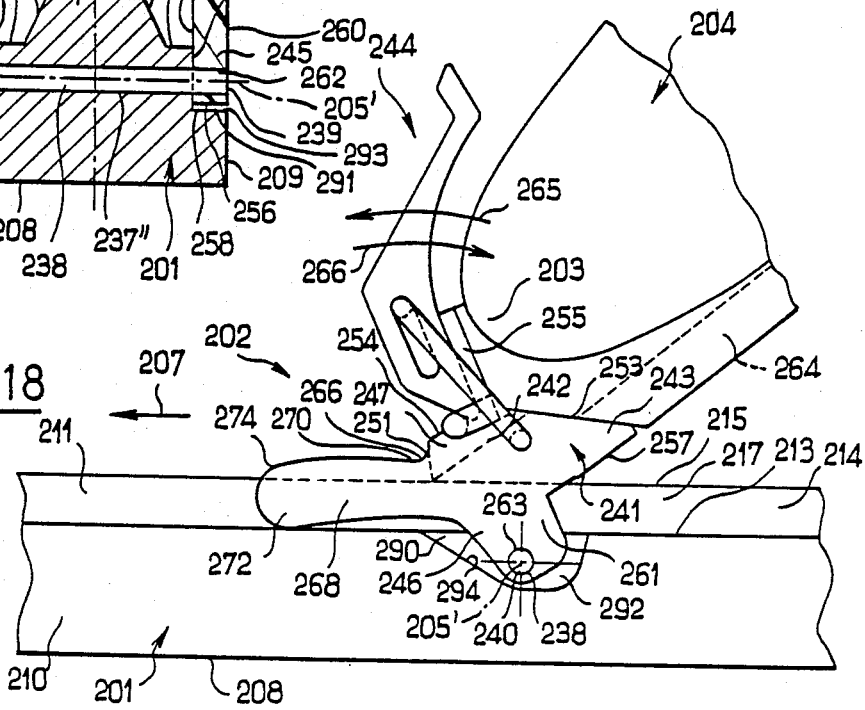

FIGS. 9–15 illustrate an alternative embodiment according to the invention which is analogous to that described with reference to FIGS. 1–8, 2*a* and 3*a*, with the only modification being that the support carries, towards the rear the retention apparatus of the front end of the boot and pivots directly on the ski, around an axis cutting the latter at the level of the rib of its upper surface. Similarly, FIGS. 16–18 illustrate an apparatus according to the invention whose support pivots directly on the ski, around an axis cutting the latter beneath the rib, this apparatus also being analogous to that which has been described with reference to FIGS. 1–8.

In FIGS. 10–14 the elements described have the reference numerals corresponding to the reference numerals of FIGS. 1–8, 2*a* and 3*a*, increased by 100 which are identical to elements of FIGS. 1–8, 2*a* and 3*a* or including modifications which will be described below. Similarly, the embodiment of FIGS. 16–18 has reference numerals of FIGS. 18, 2*a* and 3*a* increased by 200 which are identical to elements of FIGS. 1–8, 2*a* and 3*a* or having modifications which will be described below. Only elements corresponding to elements 5, 18–36, 37, 37′, 37″of FIGS. 1–8, 2*a* and 3*a* are missing from the embodiments illustrated respectively in FIGS. 9–15 and FIGS. 16–18.

Reference will be made now more particularly to FIGS. 9–15 to explain the differences between the embodiment of the apparatus according to the invention 102 illustrated in these Figures, and the apparatus 2 illustrated in FIGS. 1–8 and 2*a*, 3*a*.

As is seen more particularly in FIG. 10, the side surfaces 116 and 117 of longitudinal rib 114 have, in the central zone thereof receiving the apparatus according to the invention 102, respective hollows 191 and 192 defined towards the bottom by extensions of strips 112 and 113 in the direction of the longitudinal median plane 106 of the ski and, towards plane 106, by respective planar surfaces 189 and 190 which are mutually parallel, symmetrical to one another with respect to plane 106 and turned in the direction of a distancing with respect thereto. These surfaces 189 and 190 connect the respective extensions of strips 112 and 113 to the upper surface 115 of rib 114 thereof, and connect surfaces 116, 117 to surface 115 along the length of rectilinear extensions of junctions with surface 115. As a result, the pivot 138 has, along axis 105' as was said with respect to pivot 38, a length corresponding to the mutual spacing between the surfaces of sides 109 and 110 of ski 101 formed a protection on both sides of rib 114, with respect to surfaces 189 and 190 of hollows 191 and 192 engaging bores 138 and 139 of wings 146 and 147 of support 141 in zone 142 thereof. In order to prevent movement of support 141 along axis 105' of ski 101, surfaces 148 and 149 of the support 141, facing each other, are planar and parallel, symmetrical to one another with respect to plane 106 as was said with respect to surfaces 48 and 49, and their relative spacing is substantially identical to the relative spacing of surfaces 189 and 190 perpendicular to plane 106, such that surface 148 is flattened against surface 189 and surface 149 is flattened against surface 190, in both cases permitting relative sliding.

Furthermore, in the absence of the intermediate mounting element corresponding to element 18, surface 150 of support 141 has a planar shape adapted to mate, given a continuous clearance 152 of constant thickness, the surface 115 of rib 114 of ski 101 in the position of support 141 illustrated in FIGS. 9 and 10, in which this support 141 rests flat, by rear respective zones of lower surfaces 156 and 157 of wings 145 and 146, respectively against strip 112 and against strip 113 of the upper surface 111 of ski 101, at the rear of axis 105'. To this end, as was illustrated in FIG. 9 with respect to hollow 192, the two hollows 191 and 192 extend towards the rear beyond respective connections of surfaces 156 and 157 with surface 153 of support 141, or the surface such as 190 of hollow 192 connects to the corresponding side surface 117 of rib 114 by a transverse planar surface 193 turned towards the front.

Figure 11:
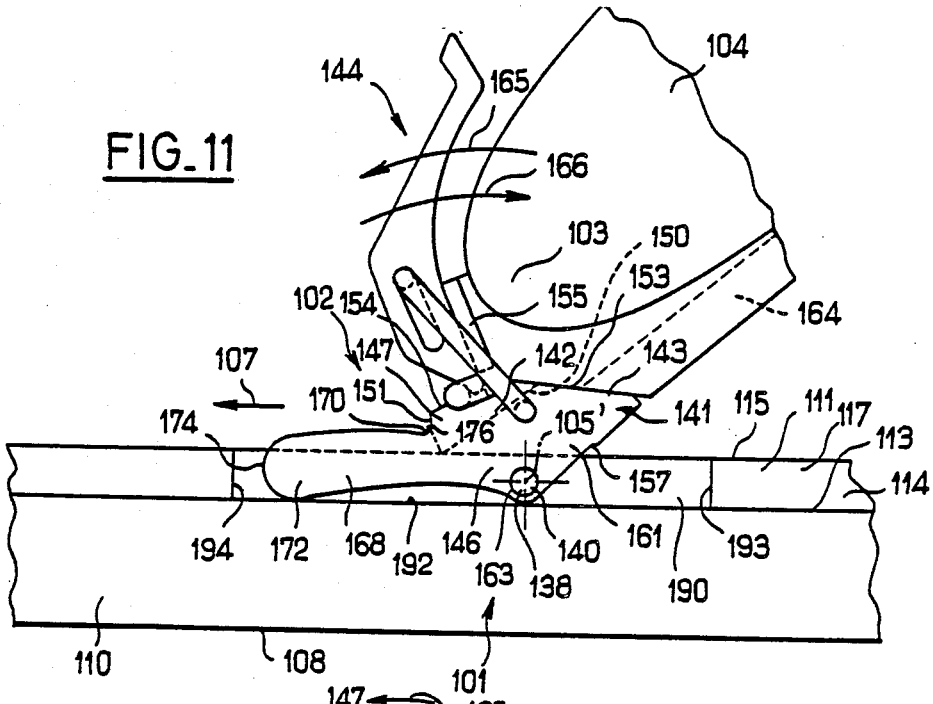

In the absence of element 18, the clearances 158 and 159 are adapted to facilitate a pivoting of support 141 in a direction 165 corresponding to a lifting of the zones of this support situated at the rear of axis 105', as illustrated in FIG. 11, are positioned between a front zone of surface 156 and strip 112, and between a front zone of surface 157 and strip 113.

Rather than sliding during pivoting in the opposite direction 166 on zones of an intermediate mounting element such as 18, the respective front ends 172, of elastically flexible tongues 167, 168 slide directly on longitudinal strips 113 of upper surface 111 of ski 101, towards the front or towards the rear along the direction of pivoting or the level to which the tongues 167, 168 are connected to support 141, as was discussed with respect to tongues 67 and 68 and of support 41 above. As with tongues 67 and 68, tongues 167, 168 are defined towards plane 106 by respective coplanar extensions of surfaces 148 and 149. To allow for their support against strips 112 and 113, surfaces 189 and 190 of hollows 191 and 192 extend beyond the front extreme position of the front ends such as 172 of the elastically flexible tongues 167, 168, as was illustrated with respect to hollow 192, by providing a front extreme transverse surface 194 which is planar, connecting its surface 190 to side surface 117 of rib 114 of ski 101. With reference to the above, it is noted that a second tongue 167, not shown, similar to tongue 67 of FIGS. 1–8 and its corresponding elements is symmetrical to tongue 168.

Rather than providing a direct sliding of the front respective ends 172 of the elastically flexible tongues 167, 168 on the longitudinal strips 112 and 113 of the upper surface 111 of ski 101, one can provide such a sliding by means of plates applied respectively on strips 112 and 113, which are preferably removable, to protect these strips 112 and 113 from abrasion by sliding. These plates affect the elastic rigidity opposed by the tongues 168 to a pivoting of support 161 in direction 165, that is, on the elastic return in direction 166 exerted by these tongues such as 168, as a function of the angular position of support 141 with respect to ski 101.

Figure 12:
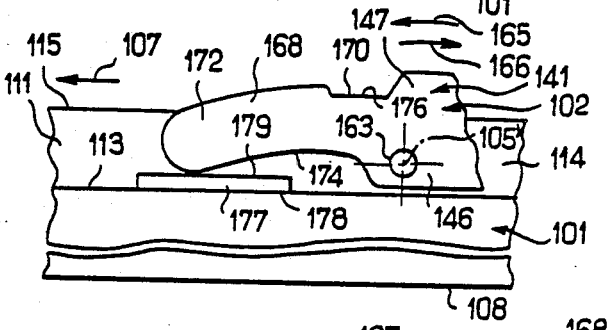
Figure 13:
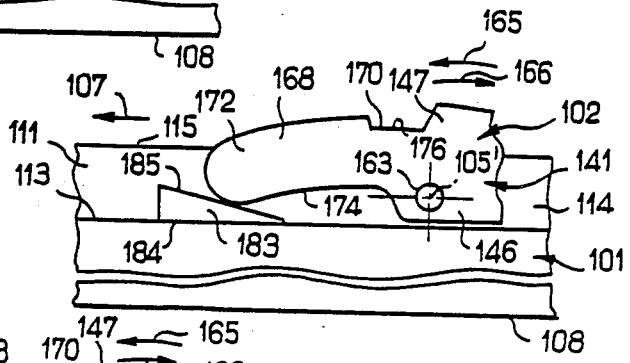
Figure 14:
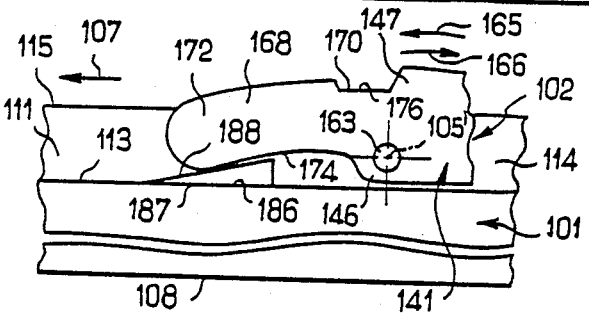

As illustrated in FIGS. 12–14 plates 177, 183, 186 having lower respective surfaces 178, 184, 187 which are planar and adapted to be applied flat against strips 113 of the upper surface 111 of the ski, and upper respective surfaces 179, 185, 188 which are planar or which may be curved if desired, defined by generating lines perpendicular to plane 106. These plates define for the front respective ends 172 of elastically flexible tongues 168 the support surfaces respectively as being of constant level with respect to the strip 113 (surface 179 of plate 177 of FIG. 12); rising towards the front with respect to the strip 113 (surface 185 of plate 183 of FIG. 13) or descending towards the front with respect to the strip 113 (surface 188 of plate 186 of FIG. 14). As was said above with respect to plates 77, 83, 86 and as is illustrated in FIG. 15 with respect to wedge 177, one can, for example assure a removable affixation of each plate 177 with the corresponding strip such as 113 of ski 101 by force-fitting a bulbous projection such as 182 of the lower surface such as 178 of the plate 177 in a blind bore such as 180 provided in the strip such as 113 of ski 101 and having a narrowing at its opening in this strip such as 113. Other means whose realization is within the skill of one of ordinary skill in the art can likewise be selected to attach, in a removable and easily interchangeable manner, the plates with strips 112 and 113 of ski 101.

If one refers to FIGS. 16–18 it is seen that rib 214 of ski 201 has a shape which is completely identical to that of rib 14 of ski 1 and that hollows 291 and 292 are provided in the ski respectively at the junction of strip 212 with the edge surface 209 and at the junction of strip 213 with the edge surface 210, in a zone localized around axis 205' positioned between surface 208 of the ski, and the strips 212 and 213 of the upper surface 211 thereof.

More precisely, each of hollows 291 and 292 is defined towards plane 206 by a planar surface, respectively 289, 290 parallel to this plane 206 and turned in the direction of a distancing with respect thereto. The two surfaces 289 and 290 are symmetrical to one another with respect to plane 206 and connect on top to strip 212 and 213, for example approximately half-way between corresponding edge surface 209 or 210 of ski 201 and the corresponding side surface 216 or 217 of rib 214 of ski 201. Naturally, surfaces 289 and 290 continue downwardly past axis 205', at a distance therefrom, without reaching bottom surface 208 of ski 201.

Openings 291 and 292 are defined by concave surfaces, turned upwardly 293 and 294, defined by generators perpendicular to plane 206 and connecting surface 289 to surface 209 and surface 290 to surface 210, respectively. Towards the front and rear, surfaces 293 and 294 are connected on top to strips 212 and 213 of the upper surface 211 of ski 201. At the front, between the rear end support limit of the respective front ends 272 of the elastically flexible tongues 268 on strips 212 and 213 and axis 205', and at the rear between the axis 205' and the position occupied by the rear respective zones of surfaces 256 and 257 of wings 245 and 246 of support 241 when it occupies its position illustrated in FIG. 16, i.e., its limit of movement position in the direction 266 with respect to ski 201, to then allow for a support which is as extended as possible of these rear zones respectively on strip 212 and strip 213.

In a corresponding fashion, wings 245 and 246 of support 241 extend downwardly, at their surfaces 248 and 249, until they cut axis 205', and surfaces 293 and 294 extend around the bottom of the zones of pivot 238 projecting with respect to surfaces 289 and 290, while allowing for a relative spacing such as exists, between the lower surfaces 256 and 257 of wings 145 and 146 and surfaces 293 and 294, of clearances 256 and 257 allowing for a free pivoting of support 241 in direction 265 from the position illustrated in FIG. 16, and a free pivoting in return in the opposite direction 266. Furthermore, as is seen in FIG. 17, surfaces 248 and 249 define symmetrical wings 245 and 246 towards plane 206, in positions parallel to plane 206 and spaced by a distance corresponding to the distance separating surfaces 289 and 290, to rest against these surfaces and be capable of sliding. Surface 250, which can maintain a planar shape as in the case of the embodiment illustrated in FIGS. 9–15, is superimposed in this case not only to surface 215 of rib 214, providing a clearance 252, but likewise to side surfaces 216 and 217 of rib 214 and to respective zones of strips 212 and 213 situated between these side surfaces of the rib and, respectively, the surfaces 289 and 290 of hollows 291 and 292.

Preferably, the elastically flexible tongues 268 are likewise defined towards plane 206, by coplanar extensions of surfaces 248 and 249. They are supported on strips 212, 213 by their front ends 272, with prestress in the non-limiting example illustrated and capable of longitudinal sliding, either directly as is illustrated in FIGS. 16–18, or by means of wedges at all points identical to those which were described with reference to FIGS. 12–14, for example mounted as is indicated with reference to FIG. 15.

It will be noted that, even though a direct mounting of support 241 on ski 201 is preferred when axis 205 cuts ski 201 beneath rib 214 of upper surface 211 thereof, one can alternatively provide for a mounting by means of an intermdiate mounting element analogous to element 18 of FIGS. 1–8. This may be accomplished by providing in the zones 31 and 32 of this element cavities adapted to receive, at the level of axis 205', the respective zones of wings 245 and 246 of support 241 having bores 262 and 263 for receiving pivot 238.

With respect to the different embodiments which have just been described, with reference respectively to FIGS. 1–8 and *2a, 3a,* 9–15 and 16–18, the possibility of affecting the rigidity of the elastically flexible tongues as a function of the angular position of the support with respect to the ski has been discussed in the form of applying plates of appropriate shape either directly on the ski (FIGS. 12–15), or on an intermediate mounting element of the apparatus according to the invention on the ski (the case of FIGS. 5–8). However, in addition to or in place of these plates, one can likewise act to this end by forming in an appropriate fashion the front ends by means of which the tongues rest for example in prestress either directly on the strips bordering the longitudinal rib of the upper surface of the ski, or on the zones of the intermediate mounting element covering these strips, and this whatever the position of the pivot axis of the support with respect to the ski.

Figure 19:
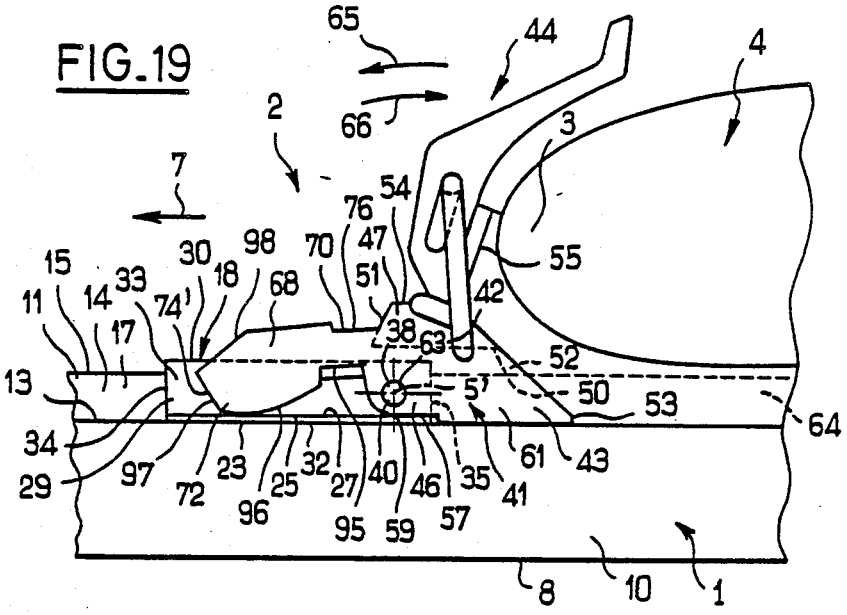
FIGS. 19–20 illustrate, in views analogous respectively to those of FIGS. 2 4, and a fourth embodiment of an apparatus according to the invention.
Figure 20:
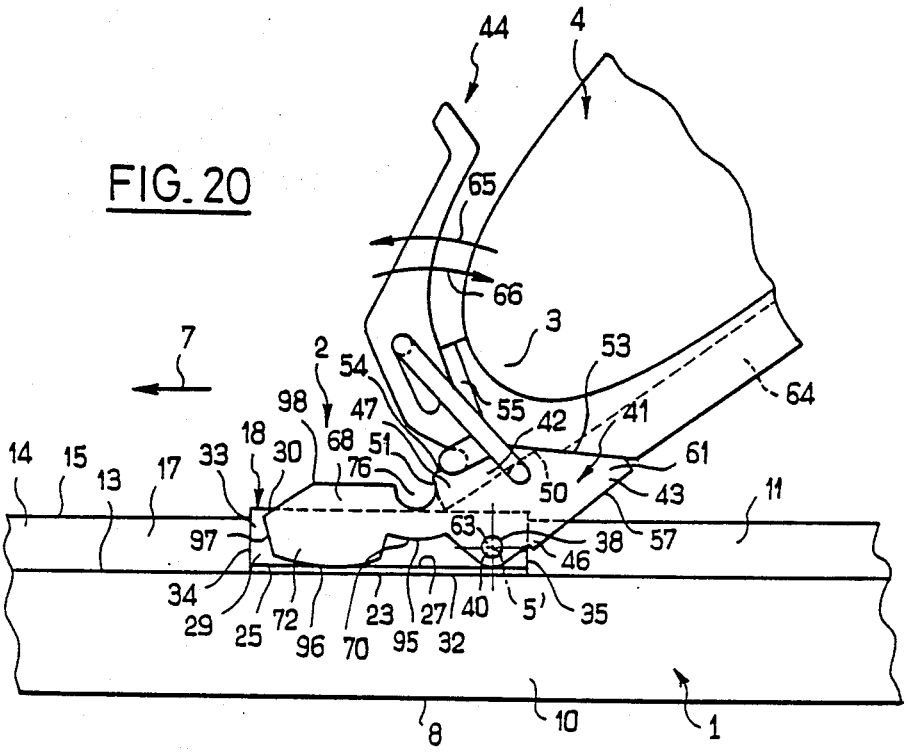

Thus, there is illustrated in FIGS. 19 and 20 an apparatus which is identical at every point to that which was described with reference to FIGS. 1–4 and *2a, 3a,* in the case of an axis cutting the ski at the level of the rib. The only difference between this embodiment and that of FIGS. 1–4 and *2a, 3a,* resides in the contour of the elastically flexible tongues.

As a result, FIGS. 19 and 20 have the same reference numerals as FIGS. 1–4 and *2a, 3a,* to designate the same elements. The flexible tongue of the alternate embodiment has a designation of reference 74' to the edge of the elastically flexible tongue 68. As in the previous embodiment, it will be noted that even though this single tongue 68 is visible in FIGS. 19 and 20, support 41 likewise carries in this case a second elastically flexible tongue symmetric to tongue 68 with respect to the longitudinal median plan of the ski.

In the case of the embodiment of FIGS. 19 and 20, edge 74' of the elastically flexible tongue 68 presents successively, from its rear end such as 70 which connects with the wing such as 46 of support 41 and core 47 thereof, an approximately planar and horizontal zone 95 turned downwardly and situated both at a level above that of axis 5' and directly beneath the cutout 76 of the tongue 68 to define the localized thinning referred to above, then a zone 96 which is likewise turned downwardly but having a convex profile adapted to be supported by a rectilinear generating line, perpendicular to the longitudinal median plane of the ski, on the surface 27 of the covering zone 32 of the longitudinal strip 113 by the intermediate mounting element 18. Towards the front, the zone 96 of edge 74' connects to a zone 97 which is planar, perpendicular to the longitudinal median plane of the ski and rising towards the front, which zone 97 connects on top to a convex zone 98 turned upwardly, and assuring the connection of zone 97 to the cutout 76 of the rear end 70 of the tongue 68.

When, as was illustrated in FIG. 20, support 41 pivots in direction 65, around axis 5', with respect to the intermediate mounting element 18 and with respect to ski 1, the front end 72 of the elastic tongue 68 tends to longitudinally displace towards the front due to the level of connection of the rear end 70 of the tongue 68 to the support 41 but, by an appropriate choice of the shape of the zone 96, within the skill of one of ordinary skill in the art, one can provide either a constant longitudinal distance between the support of this zone 96 on the surface 27 of the covering zone 32, or a variation of this distance in the direction of increase or reduction. In practice, when such a pivoting occurs in direction 65, zone 96 comes into contact with the surface such as 27 of the covering zone 32 by means of generating lines situated toward the rear on zone 96, i.e., closer to zone 95, resulting in a pivoting of the tongue assembly 68 with respect to support 1 around the thinned localized zone defined by zone 95 and cutout 75.

An arrangement can be adopted such that the journal axis of the support on the intermediate mounting element 18 occurs at the level of the rib as illustrated in FIGS. 19 and 20 or that it is located above this rib as illustrated in FIGS. 1–4, or furthermore beneath this rib, in the position illustrated in FIGS. 16–18, assuming that on intermediate mounting element is employed. In the absence of such an element, whether the axis is positioned at the level of the rib or below it, one can, however, likewise adapt the shape of the front end of the tongue described with reference to FIGS. 19 and 20.

Figure 21:
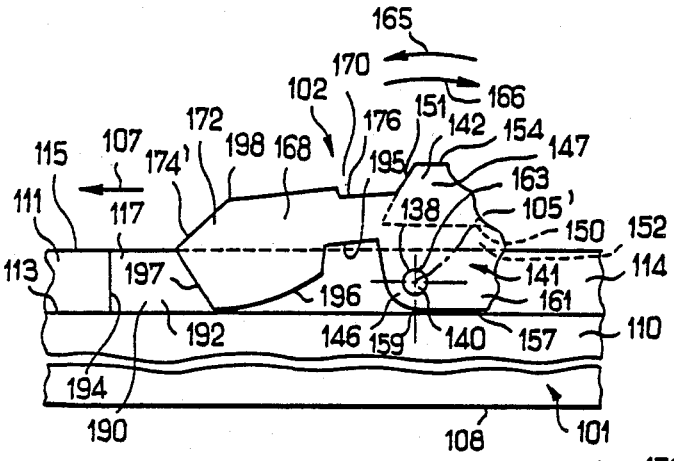
FIGS. 21 and 22 illustrate, in partial views corresponding to FIGS. 2 and 4, respectively, a fifth embodiment of an apparatus according to the invention.
Figure 22:
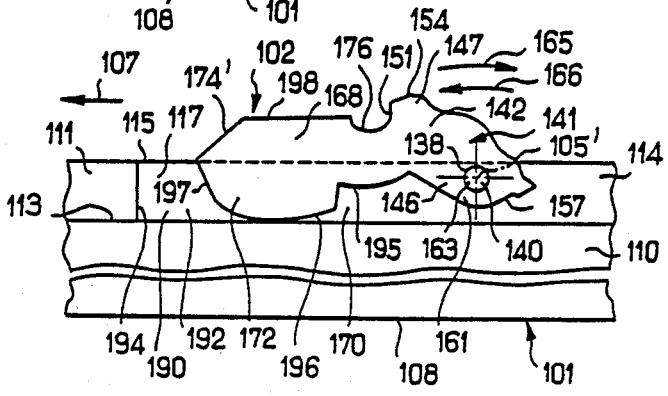

Thus, by way of non-limiting example, FIGS. 21 and 22 have been limited to an apparatus which is identical at every point to that which is illustrated in FIGS. 9–11, such that one has preserved in FIGS. 21 and 22 the same references as FIGS. 9–11, with the only exception that the front end zone 172 of each tongue 168 is directly supported on the strip 113 associated with the upper surface 111 of ski 101 through a zone 196 of its edge 174. Zone 196 has a shape which is identical at every point to the shape described with respect to zone 96 in the embodiment of FIGS. 19 and 20, with the same effects. More precisely, one finds in FIGS. 21 and 22 respectively under references 195, 196, 197, 198, elements identical to those which were described under the references 95, 96, 97, 98, respectively, with respect to the embodiment of FIGS. 19 and 20.

In the embodiment illustrated in FIGS. 21 and 22 as in the embodiment illustrated in FIGS. 19 and 20, zones 96 and 196 are shaped, in a manner which can easily be determined by one of ordinary skill in the art, as a function of the desired effect for the angular position of support 41 or 141 with respect to ski 1 or 101. This will affect the resistance of tongues 68 and 168 to a pivoting of the support in direction 65 or 165, and also the elastic return exerted by the tongues in the opposite direction 66 or 166.

In all of the embodiments of the invention which have been described, the prestressing of support of the tongues downwardly with respect to the ski, implies the application to support 41, 141, 241 of a return torque in direction 66, 166, 266 whatever the angular position of this support with respect to the ski. One will not go beyond the scope of the present invention by shaping the tongues so as to eliminate this prestress, either such that the resting of the support downwardly and rearwardly on the ski preserves a direct or indirect downward contact of the front ends of the tongues to assure a return torque as soon as the support is spaced from the support position by pivoting in direction 65, 165, 265. Alternatively, the tongues may be shaped such that the resting of the support downwardly and rearwardly on the ski causes a spacing of the front ends of the tongues upwardly with respect a direct or indirect contact position of these front ends downwardly with the ski so as to assure the application of a return torque only when the support is spaced by a predetermined angle from this support position by pivoting in direction 65, 165, 265. Such a configuration is well within the skill of one of ordinary skill in the art.

The different embodiments which have just been described assume a direct support of the front ends of the tongues either on an intermediate mounting element locally covering the ski or directly on the ski.

One can provide, however, other modes of cooperation between the respective front ends of the tongues and the ski or, preferably, an intermediate mounting element of the apparatus according to the invention on the ski, as is specifically illustrated in FIGS. 23–26 to which reference will now be made.

Figure 23:
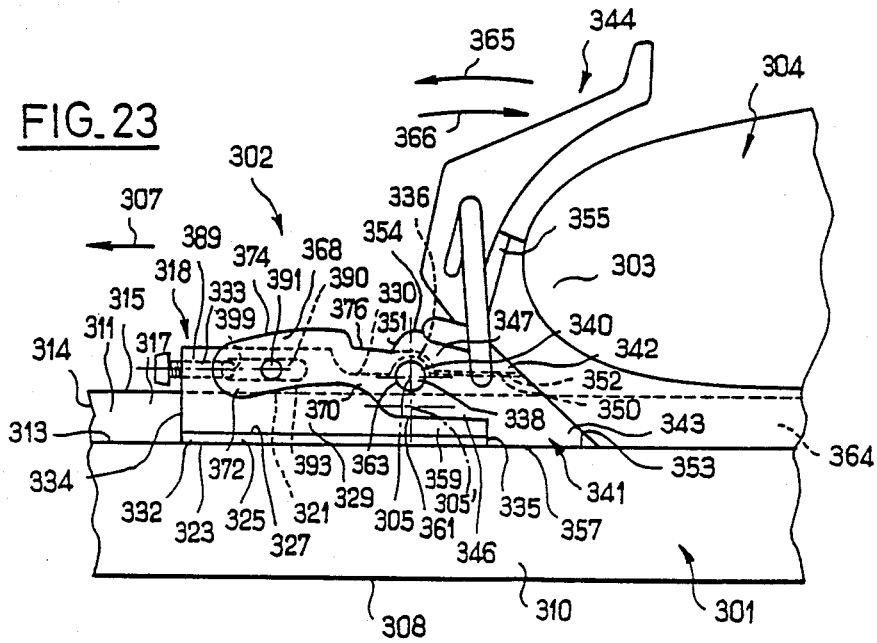
FIGS. 23 and 24 illustrate, in views analogous to FIGS. 2 and 4, respectively, a sixth embodiment of an apparatus according to the invention.
Figure 24:
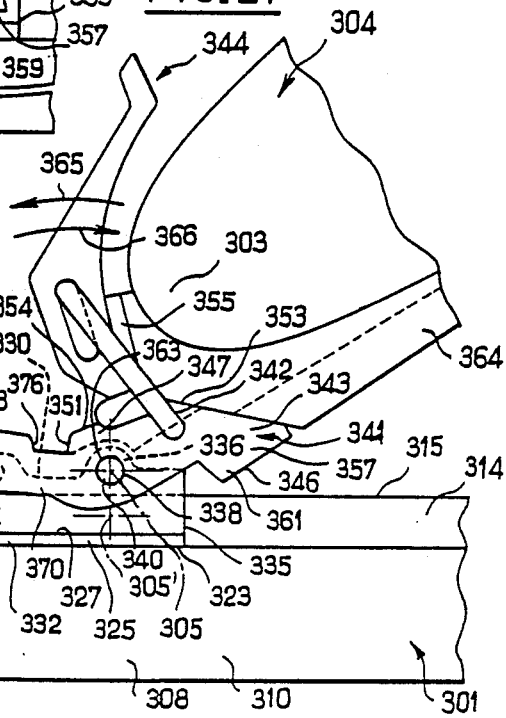

Referring first to FIGS. 23 and 24, where there has been illustrated an apparatus according to the invention 302 which, with the exception of the method of support, in prestress in the non-limiting example illustrated of the front ends of the tongues with respect to the ski, and more precisely with respect to the intermediate mounting element, is in every other respect, the same as the apparatus illustrated in FIGS. 1–4 such that one finds under the same reference numerals, incremented by 300, the elements described with reference to FIGS. 1–4, identical or including modifications which will be now described.

In the case of the embodiment of FIGS. 23 and 24, the upper surface 330 of the intermediate mounting element 318, furthermore identical to the intermediate mounting element 18 described with reference to FIGS. 1–4, has in a front zone i.e., adjacent to the front end surface 334 of element 318, a localized protuberance 389 which extends in the form of a coplanar extension upwardly, from the surface of element 318 which corresponds to surface 28 of support 18 to a coplanar extension, towards the top, of the surface 329 corresponding to surface 29. Furthermore, surface 330 has in a rear zone a localized protuberance 336 corresponding to protuberance 36, to receive pivot 338 for guidance of support 341 to rotate with respect to element 318 around axis 305 situated above rib 314 of the ski. However, as is the case with the embodiment of FIGS. *2a* and *3a*, one can provide a mutual journal around axis 305' which is itself secant to rib 314 of the ski, which implies the absence of the protuberance 336, or even around an axis situated beneath the rib of the ski resulting in an appropriate modification of element 318, as was explained with respect to the embodiment of FIGS. 16–18.

Within the localized protuberance 389 is hollowed out a logitudinal slot 390, positioned towards the bottom by a planar surface 393 parallel to surface 321 through which element 318 applies itself against upper surface 315 of rib 314, such that this surface 393 is parallel to surface 315 as to the longitudinal strips such as 313 bordering rib 314 respectively on both sides.

Slot 390 extends thus from the surface of element 318 corresponding to the surface 28 to surface 329 and receives therein, with a longitudinal clearance allowing for a longitudinal relative sliding, a rectilinear pin 391, perpendicular to the longitudinal median plane of the ski, i.e., to the axis 305 or 305', which pin constitutes a rigid transverse member rigidly affixed to front ends 372 of the elastically flexible tongues 368. In every other aspect, tongues 368 are furthermore at every point analogous to tongues 67 and 68 described with reference to FIGS. 1–4. To this end, in each of the tongues 368, the pin 391 engages in a transverse bore 392, in which it is immobilized by any appropriate means, easily within the skill of one of ordinary skill in the art. The bores such as 392 are situated, on the tongues 368, such that the engagement of pin 391 in slot 390 prevents a contact of the front end zone 372 of each tongue with the surface 327 of the covering zone 363 with which it is respectively associated, by applying, to the two tongues a downward support, in prestress against the intermediate mounting element 318, by support of pin 391 downwardly against surface 393 of slot 390.

It is easily seen that, in the case of the embodiment of FIGS. 23 and 24 as in the case of the embodiment of FIGS. 1–4, a pivoting of support 341 in direction 365 corresponding to the direction 65 or in the direction 366 corresponding to direction 66 is accompanied by a longitudinal displacement of the front respective ends of the supported tongues 368 with respect to element 318. Support of the tongues is formed by pin 391 downwardly supported on surface 393 of slot 390, and, respectively, an increase or a reduction of elastic stress of the elastically flexible tongues such as 368.

Figure 27:
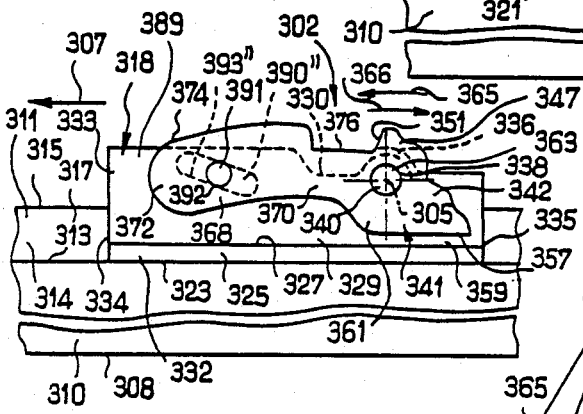

In order to modify the bias in a predetermined manner, the elastic resistance that the tongues 368 oppose to a pivoting of support 341 in direction 365, and on the effect of the elastic return of support 341 in direction 366, lower surface 393 of longitudinal slot 390 may not be positioned so that it is not parallel to surface 321 of element 318, or to surface 315 of rib 314 and to the strips 313 but rather, oblique with respect to these reference surfaces. Thus, in FIGS. 26 and 27, embodiments have been illustrated which are the same at every point to those of FIGS. 23 and 24, with the exception that slot 390 is replaced by slots 390' and 390'' defined on the bottom by respective surfaces 393' and 393''; slot 390' supports pin 391' descending towards the front with respect to surface 321 of FIG. 26 and rising towards the front with respect to this surface of FIG. 27. Seen in cross-section through the longitudinal median plane of the ski or through a plane parallel thereto, the lower respective surfaces 393, 393', 393'' of slots 390, 390', 390'' have a general rectilinear shape but one can likewise give them a curvilinear shape in such a plane, in a manner which can be easily determined by one of ordinary skill in the art as a function of the effect sought to be achieved of the influence of the tongues such as 368 on rotation of support 341.

Figure 30:
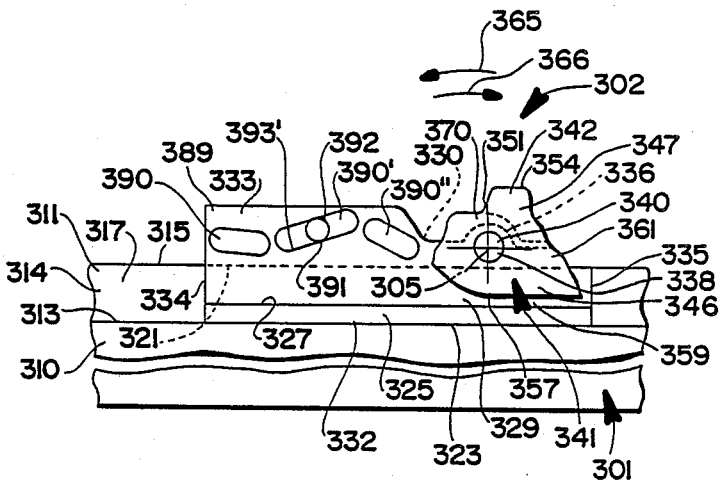
FIG. 30 is an alternative embodiment of the invention in a view analogous to that of FIG. 26.

In a manner illustrated in FIG. 30, one can superimpose in element 318, which is appropriately dimensioned, a plurality of longitudinal slots 390, 390', 390'', adapted to receive pin 391, to provide the user the option of selecting the elastic resistance effect or elastic return of the tongues 368 with respect to rotation of support 41 in direction 365 or in direction 366. FIG. 3*a* illustrates pin 392 as engaging slot 390', but it could alternately be positioned in either of slots 390 or 390''.

Figure 25:
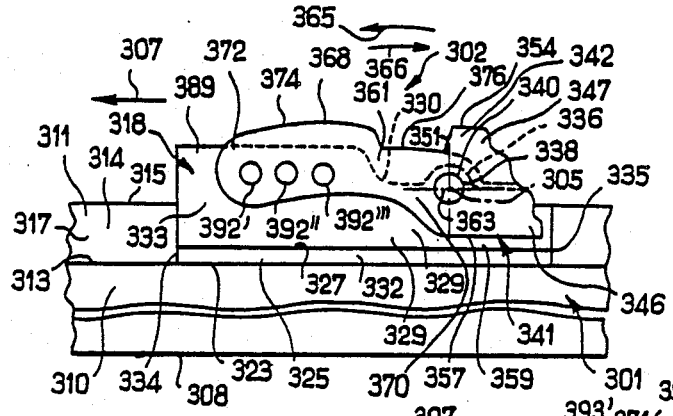
FIGS. 25–27 illustrate, in views analogous to a portion of the embodiment of FIG. 2, three alternative embodiments of the apparatus illustrated in FIGS. 23 and 24.
Figure 26:
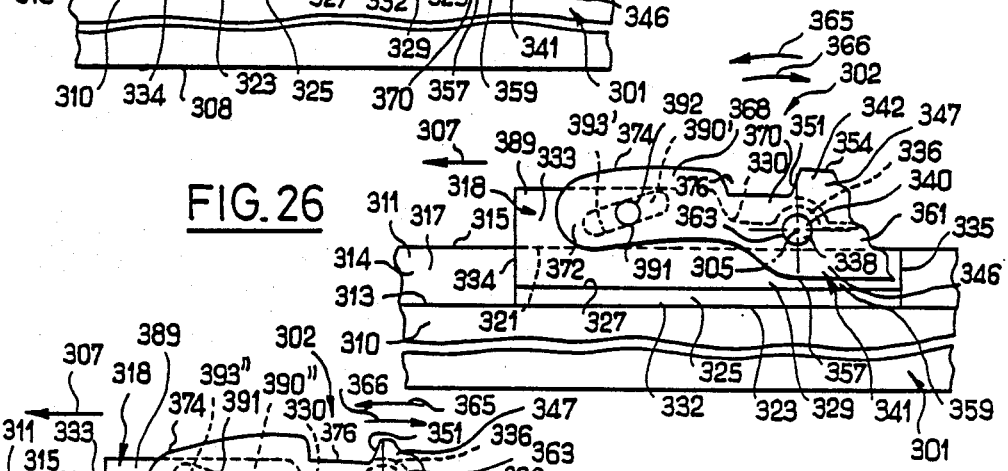

This effect may also be achieved as illustrated in FIG. 25. In that embodiment, front end 372 of tongues 368 is provided with a plurality of bores 392', 392'', 392''' distributed in a predetermined fashion and adapted to receive pin 391 which is itself engaged in slot 390' or 390'', (not shown in FIG. 25) or in one of the slots thus superimposed to be supported against element 318, in prestress of the tongues 368, through the lower surface of the slot, while providing a longitudinal clearance therein.

Figure 28:
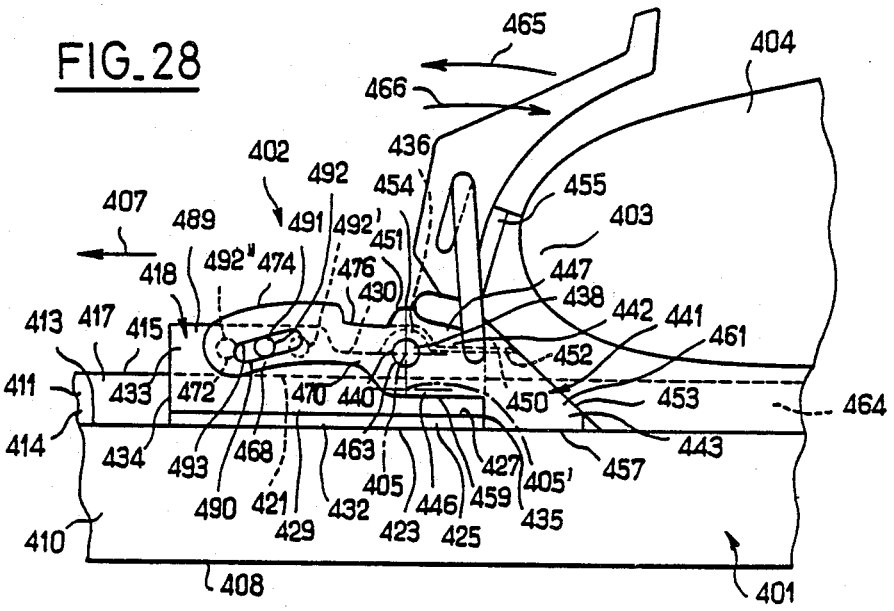
FIGS. 28 and 29 illustrate, in views analogous to FIGS. 2 and 4, respectively, a seventh embodiment of the apparatus according to the invention.
Figure 29:
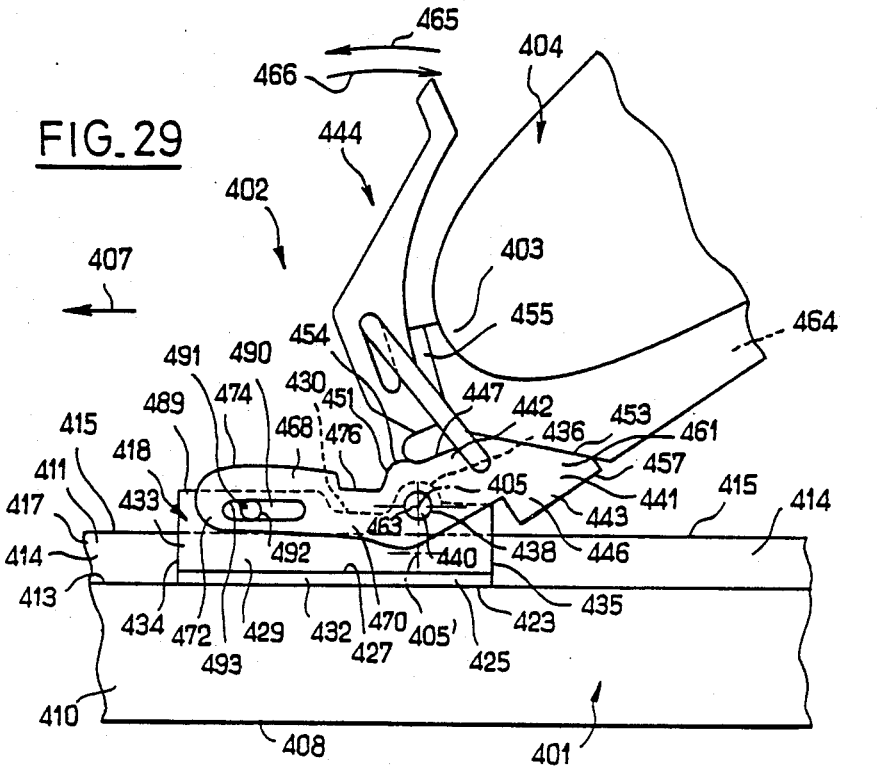

FIGS. 28 and 29 illustrate apparatus 402 according to the invention constituting another alternative embodiment described with reference to FIGS. 23 and 24. FIGS. 28 and 29 are similar to the embodiment of the apparatus illustrated in the FIGS. 23 and 24. The same reference numerals are used in FIGS. 28 and 29 as in FIGS. 23 and 24, incremented by 100. Only those elements which differ from the elements described with reference to FIGS. 23 and 24 will be explained below.

The embodiment of FIGS. 28 and 29 has an axis 405 situated above the upper surface 415 of rib 414 or an axis 405' cutting the ski at the level of rib 414, or axis situated below rib 414. These variations provide an adaptation of the configuration of intermediate mounting element 418. Protuberance 489 is positioned in a front zone of the upper surface 430 of the intermediate mounting element 418 is bored not with a slot but with transverse bore 492 perpendicular to the longitudinal median plane of the ski. This bore 492, extends from the surface of element 418 corresponding to surface 28 of element 18 to surface 429 corresponding to surface 29 of this element, receives an affixed transverse member preferably constituted by a pin 491 which is rectilinear and rigid and projects with respect to the surfaces 428, 429. Preferably, a plurality of longitudinally offset bores 492 are thus provided, as is schematically shown at 492' and 492'', and, if desired, in the direction of the height of protuberance 489, to receive selectively pin 491.

Additionally, in each of elastically flexible tongues 468 a longitudinal slot 490 is provided transversely on both sides of the tongue and having an upper surface 493 whose shape, in any cross sectional plane parallel to the longitudinal median plane of the ski, is rectilinear as is illustrated in FIGS. 28 and 29, or is curvilinear (not shown). By way of a non-limiting example, slots 490 of the tongues 468 receive pin 491 which projects onto surfaces 428, 429 of the intermediate mounting element 418 and permits relative longitudinal sliding of the tongues and the intermediate mounting element to define, by means of surface 493, a lower support of prestressed tongue 468 on pin 491 and by means thereof on intermediate mounting element 418. In such a mounting, pivoting of support 441 in the direction 465 going to the front above axis 405 or 405', is accompanied by an increase of the elastic stress of the tongues 468 accompanied by an increase of the resistance which they oppose such a pivoting as well as the elastic bias which they apply to support 441 in opposite direction 466. By an average orientation and a shape chosen from slots such as 490 and by choosing in an appropriately shaped slot 492, 492', 492'', and receiving pin 491, one can modulate these effects as a function of the angular position of support 441 with respect to intermediate mounting element 418, in a fashion easily determined by one of ordinary skill in the art.

One of ordinary skill in the art will easily understand that instead of being situated above rib 414 of upper surface 411 of ski 401 as is illustrated, the transverse member constituted by pin 491 can likewise be situated at a level such that it is secant to rib 414. In this case, it can be mounted as described with respect to axis 5' with reference to FIGS. 2*a* and 3*a*, or further be carried in an affixed manner directly by rib 414 by forming a projection respectively on both sides thereof, as is described with respect to axis 105' with reference to FIGS. 9–11, i.e., be carried by the ski without use of element 418. This element 418 can then be totally omitted if one chooses an axis 405' which is secant to the ski for journalling of the support 441 and mounted as axis 105' described with reference to FIGS. 9–11. Preferably, the option remains of choosing the positioning of pin 491 by providing a plurality of bores comparable to bores 492, 492', 492'' to receive the pin.

One of ordinary skill in the art will understand furthermore easily that instead of resting downwardly with respect to the ski, by means of a pre-stress, when support 341 or 441 is itself resting against the bottom and towards the rear with respect to the ski, the front ends of the tongues such as 368 and 468 can be such as to being not pre-stressed, or further, be pre-stressed by pressing upwardly with respect to the ski, in which case they would elastically bias support 341 or 441 for pivoting in direction 365 or 465 while the support would occupy such a support position as well as any intermediate angular position between this support position and a pre-determined angular position corresponding to a zero stress of the tongues, while the crossing by the support of this pre-determined angular position in direction 365 or 465 will cause the application to the support of an elastic return in the opposite direction 366 or 466. The realization of such alternatives is within the normal aptitude of one of ordinary skill in the art.

Furthermore, even though different embodiments of the invention which have been described assume the possibility of free longitudinal displacement of the front ends of the tongues with respect to the ski in the range of angular positions of the support with respect to the ski accessible under normal conditions of use, one would not go beyond the scope of the present invention by providing abutment means imposing on the front ends of the tongues a longitudinal displacement limit with respect to the ski either in the direction 7, 107, 207, 307, 407, or in the opposite direction, or further in one of the other of these directions, of which each corresponds respectively to a direction of rotation of the support with respect to the ski.

Thus, in FIG. 2 in which front ends 71 and 72 of tongues 67 and 68 are displaced in direction 7 when support 41 pivots in direction 65, there has been illustrated at 99 a pin extending through rib 14 and intermediate mounting element 18 on both sides along a direction perpendicular to plane 6, in the manner described with respect to pivot 38, with reference to FIGS. 2*a* and 3*a*, to form a projection with respect to surfaces 28 and 29 of element 18, above surfaces 26 and 27 of zones 31 and 32 thereof, beneath its surface 30, in front of the front ends 71 and 72 of tongues 67 and 68 with reference to direction 7. Pin 99 occupies a predetermined position such that after a pivoting of a predetermined amplitude of support 41 in direction 65 from its position illustrated in FIG. 2, by means of a flexion of tongues 67 and 68, the front ends 71 and 72 of the latter abut frontwardly against pin 99 which prevents them from pursuing their displacement in direction 7. Preferably, this abutment occurs by engagement of pin 99 in a cutout such as 100, open towards the front, which is preferably provided in edge 73, 74 of each tongue 67, 68, on the front end thereof. If the pivoting of support 41 in direction 65 continues after coming into abutment, it imposes on tongues 67 and 68 a longitudinal compression and a manner of flexion, by buckling, different from their mode of flexion during the free longitudinal displacement of their front ends resting downwardly on surfaces 26 and 27, with generally a more energetic elastic return of support 41 in direction 66. A plurality of bores perpendicular to plane 6, offset mutually particularly along a longitudinal direction, can be provided in element 18 and in rib 14, in a manner not shown, to receive as desired the pin 99.

Such an alternative embodiment can be applied to all of the embodiments of the invention illustrated in FIGS. 1–22.

Likewise, in the case of the embodiments illustrated in FIGS. 23–27 and 28, 29, one can provide that one of the ends of slots 390, 390', 390'', 490 constitutes an abutment limiting the longitudinal relative displacement of this slot and of pin 391, 491 in a direction, and/or that the other of these ends constitutes an abutment limiting the longitudinal relative displacement of the slot and of the pin in the other direction. One can likewise constitute such an abutment by means allowing for an adjustment of the longitudinal position thereof, for example, in the form of a transverse end of a longitudinal brake-screw 333 forming a longitudinal projection within the slot as illustrated in FIG. 23 where the abutment 399 is constituted by the rear transverse end of a longitudinal screw which can be screwed more or less in a longitudinal tapping of the intermediate mounting element 318, from the front surface 334 thereof and along the longitudinal median plane of the ski, to oppose an adjustable abutment to the displacement of pin 391 towards the front from a predetermined angular position of support 341 in its rotation in direction 365 such that the continuation of this rotation causes tongues 367 and 368 to compress and to buckle, with an increased elastic return. An analogous adjustable abutment can be provided to limit the displacement of pin 391 towards the rear in slot 390 such that support 341 tends to naturally occupy an angularly offset position for example, of 20° in the direction 365 with respect its position illustrated in FIG. 23, and that its passage to the position illustrated in FIG. 23, and that its passage to the position illustrated in FIG. 23 necessitates an extension of tongues 367 and 368 by continuation of rotation of support 341 in direction 366 after contact of the pin with this abutment. Analogous means can naturally be provided in the case of oblique slots 390' and 390'', as well as in the case of each of slots 490, in each tongue such as 468. When a relative abutment must be established in the two longitudinal directions, one can preferably replace the single pin 391, 491 by two pins perpendicular to plane 306, 406, mounted as was said with respect to pin 391 or 491 and mutually longitudinally offset.

In a general fashion, the embodiments of the invention which have been described are given by way of non-limiting example only, with respect to which one can provide numerous alternatives without going beyond the scope of the present invention. In particular, even in the case of the use of an intermediate mounting element to assure the guidance of the support to pivoting with respect to the ski as is illustrated in FIGS. 1–4, 2*a* and 3*a*, 19 and 20, one can provide a support of the front end zones of the tongues without using such an element as is illustrated in FIGS. 9–18, 21 and 22. Likewise, during a direct journal of the support on the ski as illustrated in FIGS. 9–11, 16–18, 21 and 22, one can provide support of the front end zones of the tongues according to the embodiments illustrated in FIGS. 1–8, 2*a* and 3*a*, 19 and 20, 23–29, i.e., by means of a piece straddling the rib of the ski in the manner of the intermediate mounting element described with reference to FIGS. 1–8, 2*a* and 3*a*, 19 and 20, 23–29.

It should be understood that although the invention has been described with respect to particular means and embodiments, the invention is not limited thereto but extends to all equivalents within the scope of the claims.

I claim:

1. Apparatus for attaching a front end of a ski boot to a ski, said ski having a longitudinal axis, an upper longitudinal surface having a longitudinal rib, a front portion and a rear portion;

said apparatus comprising a support pivotably mounted about an axis transverse to said longitudinal axis of said ski and further comprising retaining means for retaining said front end of said boot on said ski, said retaining means positioned adjacent a rear portion of said attaching apparatus;

said attaching apparatus further comprising means for elastically biasing said support towards said rear portion of said ski; and said biasing means comprising at least one longitudinal tongue attached to said support and adapted to be flexibly supported on said upper longitudinal surface, each said tongue being adapted to be displaceable along said longitudinal axis of said ski when said apparatus is attached to said ski, wherein said at least one longitudinal tongue comprises a tongue positioned on each opposite side of said longitudinal rib.

2. An apparatus for attaching a front end of a ski boot to a ski according to claim 1 wherein one end of each said tongue is longitudinally displaceable.

3. An apparatus for attaching a front end of a ski boot to a ski according to claim 1 wherein an end portion of each said longitudinal tongue is displaceable along said longitudinal axis.

4. An apparatus for attaching a front end of a ski boot to a ski according to claim 1 wherein said at least one longitudinal tongue is prestressed relative to said ski.

5. An apparatus according to claim 1 wherein said upper longitudinal ski surface comprises a longitudinal rib.

6. An apparatus according to claim 1 wherein said upper longitudinal ski surface comprises opposed strips positioned on opposite sides of said longitudinal rib and wherein said longitudinal rib projects above said strips.

7. An apparatus according to claim 1 wherein each said tongue and said support are integrally formed from a single piece of material.

8. An apparatus according to claim 1 wherein each said tongue comprises a front end, a rear end, a top portion, a bottom portion, and a pin positioned parallel to said transverse axis wherein said biasing means is adapted to be supported by said pin.

9. An apparatus according to claim 8 wherein each said tongue comprises at least one bore wherein said pin is replaceable from each said bore.

10. An apparatus according to claim 8 comprising adjustment means for adjusting the position of said pin relative to said front ends of said tongue.

11. An apparatus according to claim 1 wherein said upper surface of said ski comprises at least one longitudinal strip surface, wherein a bottom portion of each said tongue is supported by each said longitudinal strip surface; and wherein displacement of each said tongue comprises free displacement along each said strip at least over a portion of said pivoting of said support.

12. An apparatus according to claim 1 wherein said at least one tongue comprises a top portion and a bottom portion wherein at least one of said top and said bottom portions is in the shape of a wedge.

13. An apparatus for attaching a front end of a ski boot to a ski according to claim 1 in combination with a ski, said apparatus being attached to said upper ski surface.

14. Apparatus for attaching a front end of a ski boot to a ski, said ski having a longitudinal axis, an upper longitudinal surface, a front portion and a rear portion, and a longitudinal rib, said apparatus comprising:

a support pivotably mounted about an axis transverse to said longitudinal axis of said ski and further comprising retaining means for retaining said front end of said boot on said ski, said retaining means positioned adjacent a rear portion of said attaching apparatus;

said attaching apparatus further comprising means for elastically biasing said support towards said rear portion of said ski, wherein said means for elastically biasing comprises two longitudinal tongues attached to said support for positioning on opposite sides of said longitudinal rib and adapted to be flexibly supported on said longitudinal surface when said apparatus is attached to said ski.

15. An apparatus for attaching a front end of a ski boot to a ski according to claim 14 wherein said two longitudinal tongues are formed integrally with said support.

16. An apparatus for attaching a front end of a ski boot to a ski according to claim 14 wherein said transverse axis is positioned at the level of said longitudinal surface.

17. An apparatus for attaching a front end of a ski boot to a ski according to claim 16 wherein said support is mounted directly on said ski.

18. An apparatus for attaching a front end of a ski boot to a ski according to claim 14 wherein said transverse axis is vertically displaced from said longitudinal surface.

19. An apparatus for attaching a front end of a ski boot to a ski aocording to claim 18 wherein said transverse axis is positioned below said longitudinal surface.

20. An apparatus for attaching a front end of a ski boot to a ski according to claim 19 wherein said transverse axis is positioned in a recess of said ski.

21. An apparatus for attaching a front end of a ski boot to a ski according to claim 20 wherein said rear portions of said attaching apparatus rests on said upper surface of said ski.

22. An apparatus for attaching a front end of a ski boot to a ski according to claim 18 wherein said transverse axis is positioned above said longitudinal surface.

23. An apparatus for attaching a front end of a ski boot to a ski according to claim 22 comprising an intermediate mounting element mounted on said longitudinal surface.

24. An apparatus for attaching a front end of a ski boot to a ski according to claim 23 wherein said transverse axis on which said support is pivotably mounted is positioned on said intermediate element.

25. An apparatus in accordance with claim 23 wherein said upper longitudinal surface of said ski comprises two lower longitudinal strip surfaces, and wherein said intermediate mounting element comprises means for covering said longitudinal rib and said two lower longitudinal surfaces of said ski, said mounting element thereby comprising a plurality of covering zones.

26. An apparatus in accordance with claim 25, further comprising at least one wedge positioned on at least one of said covering zones for engagement with at least a respective one of said two longitudinal tongues for affecting the elastic return force imposed on said support by said respective tongue.

27. An apparatus in accordance with claim 25, wherein one of said covering zones is an intermediate zone which is positioned between two of said tongues.

28. An apparatus in accordance with claim 25, wherein said intermediate mounting element is attached to said longitudinal rib on said ski, said rib including at least a portion of said upper longitudinal ski surface, wherein said support is pivotably mounted about a transverse pivot member located on said transverse axis, and said mounting element comprising at least one substantially planar surface for supporting said transverse pivot member.

29. An apparatus for attaching a front end of a ski boot to a ski according to claim 23 further comprising a raised surface positioned on said intermediate mounting element, said raised surface comprising means for altering said elastic bias of said biasing means.

30. An apparatus for attaching a front end of a ski boot to a ski according to claim 29 wherein said raised surface is removably mounted on said intermediate mounting element.

31. An apparatus for attaching a front end of a ski boot to a ski according to claim 30 werein said removable surface is retained on said intermediate mounting element by a tongue and groove connection.

32. An apparatus for attaching a front end of a ski boot to a ski according to claim 31 wherein said tongue and groove connection comprise a projection force-fit into a hollowed cutout means positioned in said intermediate mounting element.

33. An apparatus for attaching a front end of a ski boot to a ski according to claim 29 wherein said raised surface has a substantially flat top, and wherein said tongues are slidable relative to said raised surface.

34. An apparatus for attaching a front end of a ski boot to a ski according to claim 33 wherein said raised surface comprises a cam.

35. An apparatus for attaching a front end of a ski boot to a ski according to claim 33 wherein said cam is inclined forwardly and upwardly.

36. An apparatus for attaching a front end of a ski boot to a ski according to claim 33 wherein said cam is inclined rearwardly and upwardly.

37. An apparatus according to claim 23 wherein said upper longitudinal surface of said ski has a flat surface and wherein said intermediate mounting element straddles said longitudinal rib and is complementary to said longitudinal rib and said flat surface.

38. An apparatus according to claim 37 wherein said axis about which said support is pivotably mounted extends through said intermediate element and said rib.

39. An apparatus according to claim 37 wherein said intermediate element comprises means for abutment with said support, at a rear portion of said support.

40. An apparatus according to claim 37 comprising an intermediate mounting element mounted on said longitudinal surface; a slot positioned on said intermediate mounting element on each side of said rib;

said biasing means comprising a pin positioned parallel to said transverse axis and wherein said pin is supported in each said slot.

41. An apparatus according to claim 40 wherein said pin is positioned between said front portion of said tongue and said transverse axis.

42. An apparatus according to claim 40 further comprising a longitudinal rib mounted on said upper surface of said ski wherein said pin further comprises a projection on each side of said longitudinal rib.

43. An apparatus according to claim 40 wherein said slots are inclined forwardly.

44. An apparatus according to claim 40 wherein said slots are inclined rearwardly.

45. An apparatus for attaching a front end of a ski boot to a ski according to claim 14 wherein said at least one longitudinal tongue comprises a front end having a lower surface in the shape of a wedge.

46. An apparatus for attaching a front end of a ski boot to a ski according to claim 14 wherein each said longitudinal tongue includes a zone of reduced thickness defining an elastic flexion zone.

47. An apparatus for attaching a front end of a ski boot to a ski according to claim 46 wherein said zone of reduced thickness comprises a cutout portion.

48. An apparatus according to claim 47 wherein each said longitudinal tongue comprises a top portion, a bottom portion, and a front portion, wherein said cutout portion is positioned on one of said top and bottom portions.

49. An apparatus according to claim 48 wherein said front portion comprises means for supporting each said tongue on said longitudinal upper surface and wherein said supporting means comprises a convex portion positioned on said bottom portion.

50. An apparatus according to claim 48 wherein each said longitudinal tongue comprises a front end, said front end comprising a planar zone.

51. An apparatus according to claim 14 wherein each said tongue comprises elastically flexible biasing means.

52. An apparatus according to claim 14 comprising an intermediate mounting element mounted on said upper longitudinal surface wherein each said tongue comprises a longitudinal slot and said intermediate mounting element comprises a pin engaging said slot and wherein said pin is slidable positioned within said slot.

53. An apparatus according to claim 52 wherein said longitudinal upper surface comprises a protuberance and wherein said pin is mounted on said protuberance.

54. An apparatus according to claim 52 wherein said slot is inclined forwardly.

55. An apparatus according to claim 52 wherein said slot is inclined rearwardly.

56. An apparatus for attaching front end of a ski boo to a ski according to claim 14 combination with a ski, said apparatus being attached to said upper ski surface.

57. Apparatus for attaching a front end of a ski boot to a ski, said ski having a longitudinal axis, an upper longitudinal surface, a front portion and a rear portion;

said apparatus comprising a support pivotably mounted about a fixed axis transverse to said longitudinal axis of said ski and further comprising means for retaining said front end of said boot on said ski, said retaining means positioned adjacent a rear portion of said attaching apparatus;

said attaching apparatus further comprising means for elastically biasing said support towards said rear portion of said ski and means for retaining said boot on said ski;

said biasing means comprising means fixedly attached to said support and adapted to be flexibly supported on said ski; and said biasing means being longitudinally displaceable when said apparatus is attached to said ski, wherein said attaching apparatus further comprises means for limiting displacement of said biasing means comprising a transverse element comprising means for abutment with said biasing means, and wherein said biasing means further comprises a front portion comprising a cutout adapted to engage said limiting means.

58. An apparatus for attaching a front end of a ski boot to a ski according to claim 57 wherein said biasing means is freely longitudinally displaceable.

59. An apparatus for attaching a front end of a ski boot to a ski according to claim 57 wherein said limiting means further comprises means for guiding said displacement.

60. An apparatus according to claim 57 wherein said limiting means comprises a longitudinal element, said biasing means comprises a front portion, wherein said cutout comprises a slot, said longitudinal element engaging said slot thereby limiting longitudinal displacement.

61. An apparatus according to claim 60 wherein said longitudinal element comprises an adjustable screw.

62. An apparatus for attaching a front end of a ski boot to a ski according to claim 57 in combination with a ski, said apparatus being attached to said upper ski surface.

63. Apparatus for attaching a front end of a ski boot to a ski, said ski having a longitudinal axis, an upper longitudinal surface, a front portion and a rear portion;

said apparatus comprising a longitudinal rib adapted to be positioned on said longitudinal ski surface;

said attaching apparatus having a front portion and a rear portion and further comprising a support pivotably mounted about an axis transverse to said longitudinal axis of said ski and further comprising retaining means for retaining said front end of said boot on said ski, said retaining means positioned toward said rear portion of said attaching apparatus;

said attaching apparatur further comprising at least one longitudinal tongue attached to said support, wherein said longitudinal rib includes means for guiding longitudinal movement of said at least one longitudinal tongue.

64. An apparatus for attaching a front end of a ski boot to a ski according to claim 63 in combination with a ski, said apparatus being attached to said upper ski surface.

* * * * *

UNITED STATES PATENT AND TRADEMARK OFFICE

CERTIFICATE OF CORRECTION

PATENT NO. : 4,844,503

DATED : July 4, 1989

INVENTOR(S) : J. DUNAND

It is certified that error appears in the above-identified patent and that said Letters Patent is hereby corrected as shown below:

Column 1, line 23 delete "Application Ser.".
Column 4, line 66 insert ——illustrate—— after "3a".
Column 5, line 18 change "transvere" to ——transverse——.
Column 5, line 28 change "24, and" to ——2 and 4,——.
Column 7, line 13 delete "2" after "invention".
Column 7, line 13 insert ——2—— before "according".
Column 9, line 25 delete [the] and change "of" to ——and——.
Column 9, line 26 change "38 is defined" to ——38, defined——.
Column 9, line 44 before "which" insert ——and U.S. Patent Nos. 4,382,611 and 4,484,762——.
Column 11, line 9 change "mean" to ——means——.
Column 11, line 38 change "8" to ——68——.
Column 14, line 46 change "Figs. 18" to ——Figs. 1-8——.
Column 24, line 12 delete entire line.
Column 26, line 17 change "aocording" to ——according——.
Column 27, line 6 change "werein" to ——wherein——.
Column 28, line 27 insert ——a—— before "front".
Column 28, line 27 change "boo" to ——boot——.
Column 28, line 28 insert ——in—— after "14".

Signed and Sealed this

Twentieth Day of August, 1991

*Attest:*

HARRY F. MANBECK, JR.

*Attesting Officer*

*Commissioner of Patents and Trademarks*